US007903036B2

(12) United States Patent
Takaki et al.

(10) Patent No.: US 7,903,036 B2
(45) Date of Patent: Mar. 8, 2011

(54) ANTENNA DEVICE AND WIRELESS COMMUNICATION APPARATUS USING THE SAME

(75) Inventors: Yasunori Takaki, Saitama (JP); Toshiyuki Wada, Saitama (JP); Hiroyuki Aoyama, Saitama (JP)

(73) Assignee: Hitachi Metals, Ltd., Tokyo (JP)

( * ) Notice: Subject to any disclaimer, the term of this patent is extended or adjusted under 35 U.S.C. 154(b) by 212 days.

(21) Appl. No.: 12/227,849

(22) PCT Filed: May 30, 2007

(86) PCT No.: PCT/JP2007/000579

§ 371 (c)(1),
(2), (4) Date: Feb. 3, 2009

(87) PCT Pub. No.: WO2007/141910

PCT Pub. Date: Dec. 13, 2007

(65) Prior Publication Data

US 2009/0167614 A1 Jul. 2, 2009

(30) Foreign Application Priority Data

May 31, 2006 (JP) ..... 2006-152670

(51) Int. Cl.
*H01Q 1/24* (2006.01)
*H01Q 11/12* (2006.01)

(52) U.S. Cl. ..... 343/702; 343/741; 343/700 MS

(58) Field of Classification Search ..... None
See application file for complete search history.

(56) References Cited

U.S. PATENT DOCUMENTS

| | | | | |
|---|---|---|---|---|
| 5,880,697 | A * | 3/1999 | McCarrick et al. | 343/742 |
| 6,239,753 | B1 * | 5/2001 | Kado et al. | 343/702 |
| 6,680,708 | B2 * | 1/2004 | Yamaki | 343/741 |
| 7,034,754 | B2 * | 4/2006 | Hung et al. | 343/700 MS |
| 7,342,540 | B2 * | 3/2008 | Nahar et al. | 343/702 |
| 7,671,808 | B2 * | 3/2010 | Boyle | 343/702 |
| 2005/0068234 | A1 * | 3/2005 | Hung et al. | 343/702 |
| 2005/0128151 | A1 * | 6/2005 | Kwak et al. | 343/702 |
| 2006/0017629 | A1 * | 1/2006 | Ko et al. | 343/702 |
| 2006/0197705 | A1 * | 9/2006 | Chen et al. | 343/700 MS |
| 2007/0164904 | A1 * | 7/2007 | Nahar et al. | 343/700 MS |

FOREIGN PATENT DOCUMENTS

WO 2007/141910 12/2007

* cited by examiner

*Primary Examiner* — Trinh V Dinh
(74) *Attorney, Agent, or Firm* — McGinn IP Law Group, PLLC

(57) ABSTRACT

To realize an antenna device that can operate in wide bands (in a plurality of frequency bands) and can achieve an excellent antenna gain and maintain non-directivity of vertically polarized waves in each band in a space-saving manner, and also to provide a technique capable of maintaining mechanical reliability of the antenna device.

An antenna device including; an approximately U-shaped conductor antenna, on one end side of which a power feeding portion is provided and on the other end side of which an end portion is provided as an open end terminal, and which has a folded-back portion; a base body made of an insulating material; a substrate on which said conductor antenna and said base body are mounted; conductor planes of said one end side and said the other end side of said conductor antenna constituted to be approximately perpendicular to each other; said base body being fixed on said substrate; at least said one end side of said conductor antenna being fixed on said base body; and said folded-back portion being fixed on said substrate.

20 Claims, 19 Drawing Sheets

| | Horizontal | Vertical | H/V Ave. |
|---|---|---|---|
| Ave.[dBi] | -0.70 | -15.96 | -0.58 |
| Peak[dBi] | 3.21 | -13.67 | 3.21 |

| | Horizontal | Vertical | H/V Ave. |
|---|---|---|---|
| Ave.[dBi] | -0.98 | -14.73 | -0.80 |
| Peak[dBi] | 2.37 | -10.01 | 2.37 |

| | Horizontal | Vertical | H/V Ave. | All Ave. |
|---|---|---|---|---|
| Ave.[dBi] | -14.52 | 1.01 | 1.13 | 0.01 |
| Peak[dBi] | -10.34 | 1.91 | 1.91 | |

| | Horizontal | Vertical | H/V Ave. |
|---|---|---|---|
| Ave.[dBi] | -1.55 | -18.27 | -1.45 |
| Peak[dBi] | 2.72 | -15.52 | 2.72 |

| | Horizontal | Vertical | H/V Ave. |
|---|---|---|---|
| Ave.[dBi] | -1.86 | -16.06 | -1.69 |
| Peak[dBi] | 1.63 | -10.80 | 1.63 |

| | Horizontal | Vertical | H/V Ave. | All Ave. |
|---|---|---|---|---|
| Ave.[dBi] | -16.63 | -1.19 | -1.06 | -1.40 |
| Peak[dBi] | -11.85 | 0.00 | 0.00 | |

| | Horizontal | Vertical | H/V Ave. |
|---|---|---|---|
| Ave.[dBi] | -11.82 | -22.17 | -11.44 |
| Peak[dBi] | -7.41 | -19.09 | -7.41 |

| | Horizontal | Vertical | H/V Ave. |
|---|---|---|---|
| Ave.[dBi] | -12.94 | -15.77 | -11.12 |
| Peak[dBi] | -7.45 | -12.65 | -7.45 |

| | Horizontal | Vertical | H/V Ave. |
|---|---|---|---|
| Ave.[dBi] | -16.48 | -14.60 | -12.43 |
| Peak[dBi] | -11.99 | -10.73 | -10.73 |

| All Ave. |
|---|
| -11.63 |

| | Horizontal | Vertical | H/V Ave. |
|---|---|---|---|
| Ave.[dBi] | -7.68 | -21.15 | -7.49 |
| Peak[dBi] | -3.98 | -17.23 | -3.98 |

| | Horizontal | Vertical | H/V Ave. |
|---|---|---|---|
| Ave.[dBi] | -9.61 | -9.65 | -6.62 |
| Peak[dBi] | -4.26 | -7.47 | -4.26 |

| | Horizontal | Vertical | H/V Ave. |
|---|---|---|---|
| Ave.[dBi] | -12.72 | -10.90 | -8.70 |
| Peak[dBi] | -7.48 | -6.71 | -6.71 |

| All Ave. |
|---|
| -7.52 |

| | Horizontal | Vertical | H/V Ave. |
|---|---|---|---|
| Ave.[dBi] | -6.15 | -20.52 | -5.99 |
| Peak[dBi] | -2.55 | -18.50 | -2.55 |

| | Horizontal | Vertical | H/V Ave. |
|---|---|---|---|
| Ave.[dBi] | -8.18 | -7.56 | -4.85 |
| Peak[dBi] | -2.78 | -5.36 | -2.78 |

| | Horizontal | Vertical | H/V Ave. |
|---|---|---|---|
| Ave.[dBi] | -11.72 | -9.38 | -7.38 |
| Peak[dBi] | -6.35 | -5.45 | -5.45 |

| | All Ave. |
|---|---|
| | -5.95 |

| | Horizontal | Vertical | H/V Ave. |
|---|---|---|---|
| Ave.[dBi] | -3.00 | -18.78 | -2.89 |
| Peak[dBi] | 0.30 | -14.63 | 0.30 |

| | Horizontal | Vertical | H/V Ave. |
|---|---|---|---|
| Ave.[dBi] | -5.50 | -4.56 | -2.00 |
| Peak[dBi] | 0.11 | -2.25 | 0.11 |

| | Horizontal | Vertical | H/V Ave. |
|---|---|---|---|
| Ave.[dBi] | -8.74 | -6.12 | -4.22 |
| Peak[dBi] | -3.25 | -1.84 | -1.84 |

| | All Ave. |
|---|---|
| | -2.94 |

ANTENNA DEVICE AND WIRELESS COMMUNICATION APPARATUS USING THE SAME

RELATED APPLICATIONS

This application is a 371 of PCT/JP2007/000579 filed May 30, 2007, which claims priority under 35 U.S.C 119 to an application JAPAN 2005-152670 filed on May 31, 2006, the contents of which are incorporated herein by reference.

TECHNICAL FIELD

The present invention relates to an antenna device and more particularly to the antenna device that can be applied to a plurality of bands (transmitting/receiving bands) and a wireless communication apparatus using the antenna device.

BACKGROUND TECHNIQUE

Conventionally, as an example of an antenna device mounted in a wireless communication apparatus such as a mobile phone, a mobile information terminal or a like, for example, Patent Reference 1 discloses that a chip antenna of a dielectric material or a magnetic material is attached on a substrate and then an added conductor of a phosphor bronze is connected to the chip antenna. In this antenna device, not only mechanical reliability of the chip antenna is improved by attaching the chip antenna directly on the substrate but also the antenna device is made larger in electrical volume to improve its antenna gain in a single band by connecting one end of the added conductor to an upper portion of the chip antenna.

Patent Reference 1: Δn official gazette of Unexamined Japanese Patent Publication 73024/2005

DISCLOSURE OF THE INVENTION

Problem to be Solved by the Invention

In recent years, a wireless communication apparatus such as a mobile phone or a like has become widespread and various bands are used in communications. In a recently-available mobile phone called a dual-band, triple-band, or quad-band type mobile phone in particular, one mobile phone is made to operate in a plurality of bands (transmitting/receiving bands). In such a circumstance, hurried development of an antenna device making up antenna circuits that can be embedded in a mobile phone or a like being capable of operating in a plurality of bands (transmitting/receiving bands) described above is needed. It is thus necessary that, in order to respond to needs for further miniaturization of a wireless communication apparatus such as a mobile phone and for operations in multi-bands, despite a tendency of an increase in antenna components, the antenna device not only can achieve its miniaturization and high performance but also can have its mechanical reliability. For example, it is necessary that an antenna device suffers from no destruction, and the like, even if the apparatus is dropped or subjected to a little violent treatment. In the Patent Reference 1, the antenna device disclosed therein has an added conductor of metal. It must not be caused to occur that this metal conductor suffers from damage or destruction due to an external force, and the like. Besides, the antenna device disclosed in the Patent Reference 1 is such an antenna device for use in a single band, although the metal conductor is added to the antenna device. The antenna device could not be applied to a plurality of bands (transmitting/receiving bands).

The present invention has been made in view of the above described various problems. It is therefore an object of the present invention to realize an antenna device that can operate in wide bands (in a plurality of frequency bands) and can achieve an excellent antenna gain and maintain non-directivity of vertically polarized waves in each band in a space-saving manner, and also to improve mechanical and structural reliability of the antenna device.

Means for Solving the Problem

According to the present invention, an antenna device comprising:

an approximately U-shaped conductor antenna, on one end side of which a power feeding portion is provided and on the other end side of which an end portion is provided as an open end terminal, and which has a folded-back portion;

a base body made of an insulating material;

a substrate on which said conductor antenna and said base body are mounted;

conductor planes of said one end side and said the other end side of said conductor antenna constituted to be approximately perpendicular to each other;

said base body being fixed on said substrate; at least said one end side of said conductor antenna being fixed on said base body; and said folded-back portion being fixed on said substrate.

Herein, said one end side of said conductor antenna may also be fixed on said substrate.

By configuring as above, said one end side and said open end terminal on the other end side of said conductor antenna are combined adjacently with the insulating base body of the dielectric material, the magnetic material, or the like. The antenna device thereby becomes capable of being operable in wide bands (in a plurality of frequency bands) and of achieving excellent antenna gain and of maintaining non-directivity of vertically polarized waves. At this time, the antenna device can be made smaller in height to achieve its miniaturization with a radiation area of the conductor antenna being saved. In addition to this, a plane perpendicular to the ground is formed with a certain distance being kept from a ground portion of the substrate. Thereby, planes each in which capacitive coupling occurs are decreased and then unnecessary capacitive couplings are decreased. This can further attribute to improvement of antenna gain and operability of the antenna device in a wider band of frequencies. Further, the conductor antenna has the folded-back portion, so that the conductor antenna is formed to be approximately U-shaped. However, since a conductor itself is comparatively long and plain panel-shaped, rigidity of the conductor itself is not enough. Accordingly, by supportively fixing this conductor on a substrate side except for the base body, load on the conductor can be disputed. Therefore, mechanical strength of the conductor is improved, so that reliability of the antenna device is also improved. Besides, the conductor antenna of the present invention is not limited to be U-shaped. It is enough for the conductor antenna of the present invention to have the folded-back portion. For example, the conductor antenna of the present invention can be formed to be approximately E-shaped with a plurality of folded-back portions being provided therein. These variations are totally called as the approximately U-shaped conductor antenna.

As regards supportively fixing the conductor antenna on the substrate in the present invention, it is desirable that a hook portion for fixing the conductor antenna on the substrate is provided in the conductor antenna while a notch portion corresponding to the hook portion is formed in the substrate, and so that both the conductor antenna and the substrate are jointly fixed by each flat plane on each other. Alternatively, it is also desirable that a projecting portion for fixing the conductor antenna on the substrate is provided in the conductor antenna while a hole portion corresponding to the projecting portion is formed in the substrate, and so that both the conductor antenna and the substrate are jointly fixed by fitting the projecting portion into the hole portion. Moreover, a combination of these fixing structures can also be used.

The antenna device according to the present invention may have said conductor antenna the one end side of which comprises a plate-shaped conductor consisting, for example, of a metal thin plate, and the other end side of which comprises a conductor pattern formed on a back surface of the substrate and consisting, for example, of a metal foil; an end portion of the plate-shaped conductor near the folded-back portion at the one end side being hooked into a hole portion or a notch portion formed on the substrate and being joined to said conductor pattern at the other end side; and the conductor antenna being fixed on the substrate.

By configuring as the above, the plate-shaped conductor at the one end side is supportively fixed on the base body and/or the substrate while a metal conductor pattern is connected to the other end side. Thereby, the approximately U-shaped conductor antenna is formed and, in addition, an antenna conductor can be attached and fixed on the substrate. Herein, the hole portion formed in the substrate also serves as a through hole by which not only electrical connection but also mechanical settlement are doubly implemented by the use of solder. Further, since the conductor pattern at the other end side is formed on the back surface of the substrate by printing means and the like, thickness of the substrate exists between the plate-shaped conductor at the one end side and the conductor pattern at the other end side. By the existing thickness of the substrate, capacitive coupling components are decreased, so that bandwidth of frequencies that the antenna device is operable can be enlarged.

In the antenna device according to the present invention, the one end side and the other end side of the conductor antenna may be located closely to each other through the base body, the open end terminal of the other end portion of the conductor antenna and the base body may be joined to each other, and thereby the conductor antenna may be supportively fixed by the substrate and the base body.

By configuring as the above, since the base body is located at a position of the open-end terminal where electric field strength of the U-shaped conductor antenna becomes larger, the antenna device can operate in each wide band and obtain excellent gain and maintain non-directivity of vertically polarized waves. Further, the other end portion of the conductor antenna is also connected on the base body in addition to the one end portion and the folded-back portion of the conductor antenna. Thereby, the conductor antenna can be supportively fixed on the substrate and the base body by the three points. Accordingly, a stable fixed condition can be obtained. At this time, the power feeding portion of the one end side and the open end terminal of the other end side of the conductor antenna can be directly connected, by solders, to the conductor pattern formed on the base body, so that power feeding can be implemented to the conductor pattern. Further, it is also possible that the power feeding portion and the open-end terminal of the conductor antenna are strongly fixed on the conductor pattern by adding binding materials.

Further, in the antenna device according to the present invention, the base body may be fixed on the substrate, the open end terminal of the other end side of the conductor antenna and the base body may be independently fixed on the substrate, respectively, in a condition that the open end terminal of the other end side and the base body are separated from each other. At this time, a first conductor pattern is provided on the substrate while a second conductor pattern is formed on the base body. The second conductor pattern and the open-end terminal of the other end side of the conductor antenna are connected to each other through the first conductor pattern. A third conductor pattern is formed on the base body while a fourth conductor pattern is provided on the substrate. Power is fed into the power-feeding portion of the conductor antenna through the third conductor pattern and the fourth conductor pattern.

By configuring as the above, different from the above-described structure, the base body and the conductor antenna are fixed to each other in a condition that the base body and the conductor antenna are separated from each other. Therefore, even if one of the base body and the conductor antenna is subjected to an external force, and the like, the one of the base body and the conductor antenna does not transfer the external force, and the like, to another one thereof. Accordingly, the base body and the conductor antenna can be fixed on the substrate in order that the base body and the conductor antenna may not be influenced by each other.

In the antenna device according to the present invention, it is desirable that a conductor pattern for adjusting transmitting and receiving frequencies is formed on the base body and/or the substrate. This conductor pattern for adjusting transmitting and receiving frequencies may be formed on a reverse side surface of the substrate opposite to a surface thereof on which the base body is formed. Further, the conductor pattern for adjusting transmitting and receiving frequencies may be provided near the one end side of the conductor antenna.

By configuring as the above, an adjustment of frequencies, for example, of GSM band can be implemented by readily chipping this conductor pattern for adjusting transmitting and receiving frequencies. Alternatively, the conductor pattern for adjusting transmitting and receiving frequencies may be provided near the folded-back portion of the conductor antenna. In this case, an adjustment of frequencies, for example, of DCS/PCS/UTMS bands can be implemented by chipping this conductor pattern. Thus, since an adjustment of transmitting and receiving frequencies can be implemented only by chipping the conductor pattern, the adjustment of the frequencies can be readily implemented, after the antenna device has been assembled.

Further, it is desirable that the substrate is a sub-substrate connected to a main substrate. By configuring as the above, assembling and production of the antenna device can be implemented separately and independently from a main substrate portions. Accordingly, not only a process management can be treated more easily but also an efficiency of operations can be improved.

Moreover, a cable connector may be mounted on the sub-substrate while the base body may be mounted on an end portion of the cable connector side at the longitudinal direction on the sub-substrate. Thereby, in the antenna device according to the present invention, since the base body is located at the end portion of the power feeding side, a shape of the conductor antenna on the substrate is not limited by a shape of the base body.

Furthermore, according to the present invention, the antenna device having the configurations described above is embedded in a wireless communication apparatus. Owing to this, it is made possible to save space for an antenna circuit embedded in the wireless communication apparatus and to increase a degree of freedom of arrangement (layout) of the antenna device in the wireless communication apparatus and to achieve the miniaturization of the wireless communication apparatus.

EFFECTS OF THE INVENTION

According to the present invention, it is made possible to realize a small-sized antenna device which can operate in a wide band (in a plurality of bands) and obtain excellent gain in every band and maintain non-directivity of vertically polarized waves and which also has excellent mechanical strength and reliability. Therefore, when the antenna device is applied to a wireless communication apparatus such as a mobile phone, and the like, space for the embedded antenna circuit can be saved, thus increasing a degree of freedom of arrangement (layout) which facilitate miniaturization of the wireless communication apparatus. Moreover, an adjustment of transmitting and receiving frequencies can be readily implemented. It therefore becomes possible to adjust the transmitting and receiving frequencies more easily in correspondence with an apparatus using the antenna device. Subsequently, it is possible to improve reliability of a wireless communication apparatus such as a mobile phone, and the like.

BEST MODE FOR CARRYING OUT THE INVENTION

Referring to the drawings, description will be made about embodiments of the present invention. Besides, the inventions as claimed in CLAIMS will not be limited by the embodiments described hereunder. All of the combined features described in the embodiments are not always required essentially to establish the present invention.

Referring to the drawings, a detailed description will be made as regards antenna devices according to embodiments of the present invention. At first, the description is made about a first embodiment of the present invention with reference to FIGS. 1 through 4. FIG. 1 is a diagram showing a basic configuration of an antenna device according to the first embodiment of the present invention. FIG. 2 is a diagram illustrating an equivalent circuit thereof while FIG. 3 is a diagram illustrating a detail of the antenna device according to the first embodiment. FIG. 4 is a diagram for illustrating assembly manners of the antenna device according to the first embodiment.

An antenna device 100 comprises a base body 110, a conductor antenna 120, a conductor line 130, a cable connector 131, and the like, which are mounted on a sub-substrate 140. In this sub-substrate 140, attaching portions 140*a*, 140*b* are provided on both ends of longitudinal direction of the sub-substrate. A cable connector 131 is mounted on the side of the attaching portions 140*a* in the sub-substrate 140.

Further, the antenna device 100 comprises a main substrate 150 at a position separated from the sub-substrate 140. The main substrate 150 is made of glass epoxy resin, or the like, and constitutes a Printed Circuit Board [PCB] embedded in a mobile phone, as will be described later as an wireless communication apparatus according to an embodiment of the present invention. A power feeding port 151 is provided in the main substrate 150. A coaxial cable 141 is provided between the power feeding port 151 and the cable connector 131. Connecting portions 141*a*, 141*b* are provided on the coaxial cable 141. By connecting the connecting portion 141*b* of the coaxial cable 141 to the power feeding port 151 and the connecting portion 141*a* of the coaxial cable 141 to the cable connector 131, the power feeding port 151 is electrically connected to the conductor line 130. Power is fed to the conductor antenna 120 through these conducting members.

The base body 110 is made, for example, of at least one of dielectric and magnetic materials among insulating materials to form a rectangular solid shape, and is fixed directly on the sub-substrate 140. An antenna-fixing electrode 111 is provided on an upper surface of the base body 110 while an antenna-fixing electrode 112 is provided on one side surface of the base body 110. The base body 110 is joined over between an end portion 121*a* of one end side conductor 121 of the conductor antenna 120 and an end portion 122*a* of the other end side conductor 122 of the conductor antenna 120, as will later be described. Thereby, the end portions 121*a* and 122*a* of the conductors 121 and 122 opposite to each other are capacitively coupled by way of the base body 110. In other words, a capacitance Cd is interposed between inductances Lan and Lbn. Besides, the end portion 122*a* of the other end side conductor 122 does not need to be joined on the base body but has only to be located closely to the end portion 121*a*.

The base body 110 is made of ceramics including a dielectric material, such as aluminum, silica, magnesium, and the like and having low loss characteristic at high frequencies. In a case that the dielectric material is used, an antenna characteristic is greatly influenced by a dielectric constant and a dielectric loss. Further, the base body 110 in the first embodiment is fabricated to have a size of 5.5 mm×3 mm×2 mm.

Alternatively, the base body 110 may be made of a magnetic material other than the dielectric material. In this case, the material may be hexagonal ferrite, such as z-type, y-type, and the like, called prana, and a complex material including these ferrite materials. However, it is preferable that the material is a ferrite sintering body and in particular that the y-type ferrite is used. Since the ferrite sintering body has a high volume specific resistance, the ferrite sintering body has an advantage for insulating the base body with a conductor. By using the ferrite sintering body having a high volume specific resistance, an insulating cover between the base body and the conductor becomes unnecessary. The Y-type ferrite maintains its magnetic permeability up to high frequencies not less than 1 GHz and has a little magnetic loss in a frequency band up to 1 GHz. The Y-type ferrite sintering body is not limited to a single phase one of Y-type ferrite but may include the other phases of Z-type, W-type, or the like. As regards configuration and size thereof, the base body 110 is made to form a rectangular solid shape, similarly to that of dielectric material. The base body of the ferrite sintering body may be fabricated to have a size, for example, of 5.5 mm×3 mm×2 mm, similarly to that of the dielectric material.

Further, electrodes for fixing antenna 111, 112 of the base body 110 are formed on a joined surface of the base body 110 with the conductor antenna 120 by screen-printing of electrodes. The electrodes for fixing antenna 111, 112 may be joined with the conductor antenna 120 by using a solder. An adhesive may also be used together with the solder for firmer joining.

The conductor antenna 120 is formed to be approximately U-shaped by a metal plate. In addition, the conductor antenna 120 is folded at the folded-back portion 124 so that a flat plane of one end side conductor 121 illustrated in a lower side and a flat plane of the other end side conductor 122 illustrated in an upper side opposite to each other may become substantially perpendicular to each other. Subsequently, the end portion 121*a* of one end side conductor 121 becomes a power feeding side to be connected to the power feeding port 151.

On the other hand, the end portion 122*a* of the other end side conductor 122 becomes an open-end terminal side to be connected to a part of the electrode for fixing antenna 111 of the base body 120. Herein, not the end portion 121*a* but the end portion 122*a* may become the power feeding side. This is similarly applied to the following embodiments. In such a case, the end portion 122*a* is connected to the power feeding port 151 through the electrode for fixing antenna 111. Further, the end portion 121*a* of the one end side conductor 121 becomes an open-end terminal side. Furthermore, the one end side conductor 121 is separated from the other end side conductor 122. A belt-shaped space 123 is formed between the one end side conductor 121 and the other end side conductor 122. Moreover, a part of the end portion 122*a* is folded in the conductor antenna 120 so that the other end side conductor 122, when the conductor antenna 120 is fixed, may be located in parallel or substantially in parallel to the sub-substrate 140 at a distance more separated than the base body 110 from the view point of the sub-substrate 140.

The folded-back portion 124 comprises a first folded-back portion 124*a* and a second folded-back portion 124*b*. The first folded-back portion 124*a* has the same flat surface as that of the one end side conductor 121 and is extending perpendicular toward the other end side conductor 122. The second folded-back portion 124*b* has the same flat surface as that of the other end side conductor 122 and is extending perpendicular toward the one end side conductor 121. Both the first and the second folded-back portions 124*a* and 124*b* are joined to each other to make a right angle at a position to which both are made extending respectively. Thus, the one end side conductor plane and the other end side conductor plane of the conductor antenna 120 are made substantially perpendicular to each other. In addition, the end portion 121*a* is joined to the electrode for fixing antenna 112 of the base body 110 while the other end portion 122*a* is joined to the electrode for fixing antenna 111 (However, the other end portion 122*a* may not be joined thereto). Accordingly, among the conductor antennas, the one end side conductor 121 not only exists at a position remote from the ground portion of the main substrate 150 but also is formed to be a conductor plane perpendicular to the ground portion thereof. Capacitive coupling planes can therefore be reduced and then unnecessary capacitive coupling can be reduced. As a result, a bandwidth of the antenna device can be enlarged.

The conductors 121 and 122 are capacitively coupled through the space 123. Namely, capacitances Ca1, Ca2, . . . , Ca(n−1) are interposed between inductances La1 and Lb1, La2 and Lb2, . . . , Lan and Lbn, respectively. Therefore, the space 123 has such an interval that, at least, capacitive coupling can be considered. Besides, capacitances Cb1, Cb2, Cb3, . . . , Cbn, Cb(n+1) are interposed between the conductor 121 and the ground, the conductor 122 and the ground, respectively. This conductor antenna 120 is made of a metal plate consisting, for example, of a phosphor bronze, a copper, 42 nickel, or the like. However, a gold plating or a silver plating may be applied on a surface of the conductor antenna 120 in order that the conductor antenna 120 may have a large antenna gain and a low loss by making a resistance value thereof be small.

The sub-substrate 140 is fixed on a non-illustrated housing by attaching portions 140*a* and 140*b* being screwed in the housing. The sub-substrate 140 is adjusted to be conductive by connecting the attaching portion 140*a* to the ground of the housing. Further, a conductor line 130 and a cable connector 131 are mounted at a side of the attaching portion 140*a* on the sub-substrate 140. Then, the base body 110 and the conductor antenna 120 will be mounted on the sub-substrate 140, as mentioned above.

The antenna device 100 operates in transmitting and receiving frequency bands each being different from one another. More specifically, a (folded-back) total length portion (¼λ of GSM band) of the conductor antenna 120 operates in a GSM band (900 MHz band), a half length portion (substantially ¼λ of DCS band and PCS band) of the conductor antenna 120 in a DCS band (1700 MHz band) and a PCS band (1800 MHz band), and in an UMTS band (2200 MHz band), thereby achieving the quad-band type antenna device 100. Thus, the total length portion (¼λ of GSM band) of the conductor antenna 120 has the GSM band as its transmitting and receiving frequency band of frequencies being the lowest band of frequencies. The half length portion (substantially ¼λ of DCS band and PCS band) of the conductor antenna 120 has the DCS band and the PCS band as its two transmitting and receiving frequency bands which are different from each other but are near each other. Moreover, the base body 110 portion including the end portion 121*a* of the one end side conductor 121 and the end portion 122*a* of the other end side conductor 122 of the conductor antenna 120 has the UMTS band as its transmitting and receiving frequency band being higher than those in the DCS/PCS bands.

Besides, the conductor antenna 120 according to the first embodiment is made of the metal plate having a thickness of 0.3 mm and consisting of a phosphor bronze, or the like. Further, the gold plating, or the like is applied on the surface of the conductor antenna 120 in order that the conductor antenna 120 may have a large antenna gain and a low loss by making a resistance value thereof be small. The wider a sum of the widths of a width of the one end side conductor 121 and a width of the other end side conductor 122 is, the higher a radiation efficiency of the antenna device is to have a wide band of frequencies. However, if the width is made too large, an area opposite to the ground is too increased. Consequently, a substantial distance becomes near, so that band width (BW) and an antenna gain are decreased in turn. Accordingly, it is desirable that the widths of conductors are adjusted within a range where the band width (BW) does not become too narrow and the antenna gain is not decreased. For example, herein, since the width of the one end side conductor 121 is formed to be narrower than the width of the other end side conductor 122, the antenna gain becomes high in lower frequency side, such as the GSM band (900 MHz band), and the like. On the other hand, if it is hoped that the antenna gains becomes high in higher frequency side, such as the DCS band (1700 MHz band), the PCS band (1800 MHz band), the UMTS band (2200 MHz band), and the like, the width of the one end side conductor 121 should be formed to be wider than the width of the other end side conductor 122. Thus, the widths of the one end side conductor 121 and the other end side conductor 122 should be determined so that deflection of the antenna gain may not be produced between the lower frequency side and the higher frequency side.

Next, referring to FIG. 4, description will proceed to a fixing structure of the conductor antenna. When the antenna device 100 is assembled, at first, the base body 110 is directly fixed on the sub-substrate 140 by soldering through a conductor foil formed on the joined surface of the base body 110. Notch portions 142*a* and 142*b*, that are antenna-fixing portions for fixing the conductor antenna 120 are provided in the sub-substrate 140. On the other hand, the end portion 121*a* of the conductor antenna 120 is formed as a projecting portion 121*aa* fitting into the notch portion 142*a*. Further, a hook portion 124*aa* hooking into the notch portion 142*b* of the sub-substrate side is formed at the lower end side of the first folded-back portion 124*a* of the conductor 121.

Then, the conductor antenna 120 has been attached to the sub-substrate 140 by adjusting and inserting the projecting portion 121*aa* and the hook portion 124*aa* of the conductor antenna 120 into the notch portions 142*a* and 142*b* from the illustrated front side. Further, the projecting portion 121*aa* and the hook portion 124*aa* of the conductor antenna 120 are joined to the notch portions 142*a* and 142*b*, respectively, by soldering. Both the one end side and the folded-back portion of the conductor antenna 120 have been fixed on the sub-substrate 140. Furthermore, in this example, the end portion 122*a* of the other end side conductor 122 is joined by soldering to the electrode for fixing antenna 111 that has already fixed on the base body 110. The conductor antenna 120 has thereby been fixed on the sub-substrate 140 firmly. Besides, the projecting portion 121*aa* is in a manner that the projecting portion 121*aa* comes into contact with and is joined to the electrode for fixing antenna 112 of the base body 110 and the conductor line 130, when the projecting portion 121*aa* has been joined to the notch portion 142*a*.

Thus, not only the conductor antenna 120 is joined to the base body 110 but also the projecting portion 121*aa* and the hook portion 124*aa* are fixed on the sub-substrate 140 in the antenna device 100 according to the first embodiment. The conductor antenna 120 is therefore supported by three points on the sub-substrate 140. Further, in this example, since the end portion 122*a* of the conductor antenna 120 is fixed on the base body 110, a load of the conductor antenna 120 is applied on the base body 110. At this time, since the other two points of the conductor antenna 120 is fixed on the sub-substrate 140, it can be considered that the other end side conductor 122 of the conductor antenna 120 is a cantilever having the side of the folded-back portion 124 as a fixed end and the end portion 122*a* as a free end. In this case, the end portion 122*a* is folded from the other end side conductor 122 toward the base body 110. Therefore, the load applied on the base body 110 turns out to be a power pushing the base body 110 downward, namely toward the sub-substrate 140. In the antenna device 100 according to the first embodiment, the base body 110 and the conductor antenna 120 are thereby fixed stably and firmly so that the base body 110 and the conductor antenna 120 may not easily removed. Mechanical reliability of the antenna device 100 is thus improved.

In addition, as illustrated in FIG. 5, in the antenna device 100 according to the first embodiment, the electrode for fixing antenna 111 of the base body 110 is in a manner that the electrode for fixing antenna 111 is joined only by a part thereof to the end portion 122*a* of the conductor antenna 120. With the manner, even if the base body 110 is being fixed on the sub-substrate 140, a part of the electrode for fixing antenna 111 formed on the base body 110 can be processed, for example, be chipped, and the like, as shown by a broken line in FIG. 5. Accordingly, the transmitting and receiving frequencies of the antenna device 100 especially in the GSM band can be adjusted only by chipping the electrode for fixing antenna 111.

Next, referring to FIGS. 6 through 11, description is made about a performance of the antenna device 100 according to the first embodiment. FIG. 6 is a diagram illustrating an antenna characteristic of the antenna device 100 in a GSM band while FIG. 7 is a diagram illustrating an antenna characteristic of the antenna device 100 in DCS-UMTS bands. Further, FIGS. 8 through 11 are diagrams illustrating antenna gain directivity characteristics of the antenna device 100 at the central frequency of transmitting band and receiving band in GSM, DCS, PCS, UMTS bands, respectively.

FIG. 6(*a*), (*b*), (*c*) show antenna directivity stereoscopically among antenna characteristics of the antenna device according to the first embodiment in the GSM band, and two-dimensionally showing the antenna directivity expressed by curves obtained by plotting the distribution from the central point respectively at cross sections of an XY plane, YZ plane, and ZX plane using the three-dimensional X, Y, and Z axes as a reference axis. Namely, E2-plane shown in FIG. 6(*a*) is XY plane, E1-plane shown in FIG. 6(*b*) is YZ plane, and H-plane shown in FIG. 6(*c*) is ZX plane.

These drawings show that, when the distribution expressed by the curve from the central point is the larger from the central point toward a direction of a diameter, the directivity is the higher, that is, the gain is the higher and when the distribution is uniform from the central point toward a direction of a diameter and the curve become a circle the more, a drop in the directivity, that is, in the gain is the less and the more uniform. As the directivity of an antenna to be mounted, for example, on a mobile phone terminal, the antenna directivity on the ZX plane shown in FIG. 6(*c*) among the cross-sectional planes is important and it is desirable that the gain becomes maximum at the ZX plane and uniform gain and directivity are obtained at the ZX plane. This means that the uniform gain and directivity can be obtained in a direction orthogonal to a plane of the above-described sub-substrate 140.

That is, this means that how much the uniform gain and directivity can be obtained in a circumferential direction relative to the sub-substrate 140. In the mobile phone terminal, the sub-substrate 140 and a main substrate 150 connected to the sub-substrate 140 for the antenna device is mounted along a longitudinal direction of a cabinet of the thin and long mobile phone terminal and, therefore, how uniform gain and directivity can be obtained in the circumferential direction of the cabinet of the mobile phone terminal is of importance. If the uniform gain and directivity in the circumferential direction of the cabinet of the mobile phone terminal, the directivity can be easily controlled depending on arrangements of metal portions in the cabinet. As a result, uniformity (non-directivity) of directivity of vertically polarized waves on the ZX plane becomes important. Therefore, it is desirable that the distribution expressed by a curve representing directivity of vertically polarized waves in the ZX plane is uniform from a central point toward a direction of a diameter and that the curve become near to a (true) circle. In the data on the ZX plane shown in FIG. 6(*c*), the curve (Vertical) representing directivity of vertically polarized waves becomes a uniform circle (true circle) at about 0.00. Further, a drop in gain in the illustrated X direction is not observed. It is therefore understood that the uniform directivity and gain can be obtained.

FIG. 7(*a*), (*b*), (*c*) show antenna directivity stereoscopically (three-dimensionally) among antenna characteristics of the antenna device 100 according to the first embodiment in the DCS-UMTS bands, similarly to those shown in FIG. 6(*a*), (*b*), (*c*). In the data on the ZX plane shown in FIG. 7(*c*), the curve (Vertical) representing directivity of vertically polarized waves substantially becomes a circle. Further, a drop in gain is a little. It is therefore understood that necessary and sufficient directivity and gain for practical use can be obtained.

FIG. 8 shows antenna gain and directivity at the center frequencies of transmitting and receiving bands in the GSM band among gain directivities of the antenna device 100 according to the first embodiment. Herein, FIG. 8(*a*), (*b*), (*c*) show antenna gains and directivities at E2-plane, E1-plane, and H-plane in GSM-Tx (center frequency of transmitting band in the GSM band), respectively. FIG. 8(*d*), (*e*), (*f*) show antenna gains and directivities at E2-plane, E1-plane, and H-plane in GSM-Rx (center frequency of receiving band in the GSM band), respectively. Besides, in the first embodiment, the center frequency of the transmitting band in the GSM band is 895.5 MHz while the center frequency of the receiving band in the GSM band is 940.5 MHz.

In the data on the H-plane shown in FIG. 8(*c*), (*f*), the curve (Vertical) representing directivity of vertically polarized waves becomes a uniform circle (true circle) at about 0.00. Further, a drop in gain in the illustrated X direction is not observed. Namely, in the antenna device 100, it is understood that the uniform directivity and gain can be obtained even in the transmitting and the receiving bands in the GSM band.

FIG. 9 shows antenna gain and directivity at the center frequencies of transmitting and receiving bands in the DCS band among gain directivities of the antenna device 100 according to the first embodiment. Herein, FIG. 9(*a*), (*b*), (*c*) show antenna gains and directivities at E2-plane, E1-plane, and H-plane in DCS-Tx (center frequency of transmitting band in the DCS band), respectively. FIG. 9(*d*), (*e*), (*f*) show antenna gains and directivities at E2-plane, E1-plane, and H-plane in DCS-Rx (center frequency of receiving band in the DCS band), respectively. Besides, in the first embodiment, the center frequency of the transmitting band in the DCS band is 1747.5 MHz while the center frequency of the receiving band in the DCS band is 1842.6 MHz.

In the data on the H-plane shown in FIG. 9(*c*), (*f*), the curve (Vertical) representing directivity of vertically polarized waves partially has a so-called null point (point of the drop in gain). However, the curve (Horizontal) representing directivity of horizontally polarized waves compensates for the point. Thereby, both combined Vertical and Horizontal substantially becomes a circle. Further, a drop in gain in the illustrated X direction is a little. Namely, in the antenna device 100, it is understood that necessary and sufficient directivity and gain for practical use can be obtained even in the transmitting and the receiving bands in the DCS band.

FIG. 10 shows antenna gain and directivity at the center frequencies of transmitting and receiving bands in the PCS band among gain directivities of the antenna device 100 according to the first embodiment. Herein, FIG. 10(*a*), (*b*), (*c*) show antenna gains and directivities at E2-plane, E1-plane, and H-plane in PCS-Tx (center frequency of transmitting band in the PCS band), respectively. FIG. 10(*d*), (*e*), (*f*) show antenna gains and directivities at E2-plane, E1-plane, and H-plane in PCS-Rx (center frequency of receiving band in the PCS band), respectively. Besides, in the first embodiment, the center frequency of the transmitting band in the PCS band is 1880 MHz while the center frequency of the receiving band in the PCS band is 1960 MHz.

In the data on the H-plane shown in FIG. 10(*c*), (*f*), the curve (Vertical) representing directivity of vertically polarized waves partially has a null point (point of the drop in gain). However, the curve (Horizontal) representing directivity of horizontally polarized waves compensates for the point. Thereby, both combined Vertical and Horizontal substantially becomes a circle. Further, a drop in gain in the illustrated X direction is a little. Namely, in the antenna device 100, it is understood that necessary and sufficient directivity and gain for practical use can be obtained even in the transmitting and the receiving bands in the PCS band.

FIG. 11 shows antenna gain and directivity at the center frequencies of transmitting and receiving bands in the UMTS band among gain directivities of the antenna device 100 according to the first embodiment. Herein, FIG. 11(*a*), (*b*), (*c*) show antenna gains and directivities at E2-plane, E1-plane, and H-plane in UMTS-Tx (center frequency of transmitting band in the UMTS band), respectively. FIG. 11(*d*), (*e*), (*f*) show antenna gains and directivities at E2-plane, E1-plane, and H-plane in UMTS-Rx (center frequency of receiving band in the UMTS band), respectively. Besides, in the first embodiment, the center frequency of the transmitting band in the UMTS band is 1950 MHz while the center frequency of the receiving band in the UMTS band is 2140 MHz.

In the data on the H-plane shown in FIG. 11(*c*), (*f*), the curve (Vertical) representing directivity of vertically polarized waves substantially becomes a circle. Further, a drop in gain in the illustrated X direction is a little. Namely, in the antenna device 100, it is understood that necessary and sufficient directivity and gain for practical use can be obtained even in the transmitting and the receiving bands in the UMTS band.

With the constitution for mounting, it becomes possible to keep a distance between the base body 110 or the conductor antenna 120 and the ground of the main substrate 150. Accordingly, it is possible to realize the antenna device 100 that can operate in wide bands and can achieve an excellent antenna gain by the base body 110 and the conductor antenna 120.

Next, description is made about a second embodiment of the present invention with reference to FIGS. 12 and 13. FIG. 12 is a diagram showing a basic configuration of an antenna device according to a second embodiment of the present invention. FIG. 13 is a diagram illustrating assembly processes of the antenna device according to the second embodiment. Besides, the second embodiment of the present invention has some portions similar to those of the first embodiment. The similar portions are designated by like reference numerals and of which explanations are omitted.

An antenna device 200 comprises a base body 110, a conductor antenna 220, a conductor line 230, and the like, which are mounted on a mounting area 240 provided in a main substrate 250. The main substrate 250 is made of the same material as that of the main substrate 150 of the first embodiment. A power feeding port 251 and a conductor line 241 are provided in the main substrate 250. Further, the power feeding port 251 is electrically connected to the conductor line 241 and an antenna-fixing electrode 112. Power is fed to the conductor antenna 220 through these conducting members.

The conductor antenna 220 is formed to be approximately U-shaped by a metal (a phosphor bronze having a thickness of 0.3 mm) thin plate member. In addition, the conductor antenna 220 is folded at a folded-back portion 224 so that a flat plane of one end side conductor 221 illustrated in a lower side and a flat plane of the other end side conductor 222 illustrated in an upper side opposite to each other may become substantially perpendicular to each other. Subsequently, an end portion 221*a* of one end side conductor 221 becomes a power feeding side to be connected to the power feeding port 261. On the other hand, an end portion 222*a* of the other end side conductor 222 becomes an open-end terminal side to be connected to a part of an electrode for fixing antenna 111 of a base body 220. Further, the one end side conductor 221 is separated from the other end side conductor 222. A belt-shaped space 223 is formed between the one end side conductor 221 and the other end side conductor 222. Moreover, the conductor antenna 220 is formed so that the other end side conductor 222, when the conductor antenna 220 is fixed, may be located in parallel to the mounting area 240 substantially at the same distance as that of the base body 110 from the view point of the mounting area 240.

The folded-back portion 224 substantially comprises a first folded-back portion 224*a* and a second folded-back portion 224*b*. The first folded-back portion 224*a* has the same flat surface as that of the one end side conductor 221 and is extending perpendicular toward the other end side conductor 222. The second folded-back portion 224*b* has the same flat surface as that of the other end side conductor 222 and is extending perpendicular toward the one end side conductor 221. Both the first and the second folded-back portions 224*a* and 224*b* are joined to each other to make a right angle at a position to which both are made extending respectively to meet with each other. By such a configuration of the folded-back portion 224, in the second embodiment, the end portion 221*a* of the conductor antenna 220 can detour from the base body 110 and be joined to the electrode for fixing antenna 112 while the end portion 222*a* can be joined to the electrode for fixing antenna 111.

FIG. 13 is a diagram for explaining assembly processes of the antenna device 200 according to the second embodiment. When the antenna device 200 is assembled, at first, the base body 110 is directly fixed on the mounting area 240 and then the conductor antenna 220 is fixed thereon. Antenna-fixing holes 242*aa*, 242*ab*, 242*b* each constituted by a through hole for fixing the conductor antenna 220 are provided in the mounting area 240. On the other hand, projecting portions 221*aa*, 221*ab* fitting into the antenna-fixing holes 242*aa*, 242*ab* are provided in a head portion of the end portion 221*a* of the conductor antenna 220. Further, a projecting portion 224*aa* is provided in a portion of the conductor antenna 220 in which both the one end side conductor 221 and the first folded-back portion 224*a* are folded back toward an illustrated lower end. The projecting portion 224*aa* is fitted into the antenna-fixing hole 242*b*.

Then, the conductor antenna 220 has been attached to the mounting area 240 by adjusting and inserting the projecting portions 221*aa*, 221*ab*, 224*aa* of the conductor antenna 220 into the antenna-fixing holes 242*aa*, 242*ab*, 242*b* from the illustrated upper side. Further, the projecting portions 221*aa*, 221*ab*, 224*aa* of the conductor antenna 220 are joined to the antenna-fixing holes 242*aa*, 242*ab*, 242*b*, respectively, by soldering. Furthermore, the end portion 222*a* is joined by soldering to the electrode for fixing antenna 111 that has already fixed on the base body 110. The conductor antenna 220 has thereby been fixed on the mounting area 240. Besides, the projecting portion 221*aa* is in a manner that the projecting portion 221*aa* comes into contact with and is joined to the electrode for fixing antenna 112 of the base body 110 and the conductor line 241, when the projecting portion 221*aa* has been joined to the antenna-fixing hole 242*aa*.

Thus, in the antenna device 200 according to the second embodiment, not only one end side of the conductor antenna 220 is joined to the base body 110 but also the conductor antenna 220 is fixed on the mounting area 240 by four points of the projecting portions 221*aa*, 221*ab*, 224*aa*, and the end portion 222*a*. The conductor antenna 220 is therefore supported by the four points on the mounting area 240.

Further, since the end portion 222*a* of the conductor antenna 220 is fixed on the base body 110 that has been directly fixed on the mounting area 240, a load of the conductor antenna 220 is applied on the base body 110. At this time, in the conductor antenna 220, the projecting portion 224*aa* is fixed on and supported by the mounting area 240, the conductor 222 is fixed so that the conductor 222 may become parallel to the mounting area 240 with being separated from the mounting area 240 by substantially the same distance as that from the mounting area 240 to the electrode for fixing antenna 111. Consequently, it can be considered that the other end side conductor 222 is a both ends support beam supported by both the base body 110 and the projecting portion 224*aa*. Therefore, the load applied onto the base body 110 from the other end side conductor 222, that acts in a direction for tearing the base body 110 off, turns out to be distributed by the projecting portion 224*aa*. As a result, the load applied onto the base body 110 is reduced to be approximately a half thereof.

In addition, in the antenna device 200 according to the second embodiment, a pattern for adjusting transmitting and receiving frequencies 243 (shown by a dotted line) is provided on a back surface of the mounting area 240, that is reverse to the surface on which the base body 110, and the like were mounted. The pattern for adjusting transmitting and receiving frequencies 243 is connected to the projecting portion 224*aa* through an antenna-fixing portion 242*b*. Accordingly, the transmitting and receiving frequencies of the antenna device 200 especially in the DCS/PCS/UMTS bands can be adjusted only by chipping a part of the pattern for adjusting transmitting and receiving frequencies 243.

Accordingly, with the constitution thus mentioned, the antenna device 200 according to the second embodiment can obtain advantageous effects similar to those of the antenna device 100 according to the first embodiment.

Next, description is made about a third embodiment of the present invention with reference to FIGS. 14 and 15. FIG. 14 is a diagram showing a basic configuration of an antenna device according to a third embodiment of the present invention. FIG. 15 is a diagram illustrating assembly processes of the antenna device according to the third embodiment. Besides, the third embodiment of the present invention has some portions similar to those of the first and the second embodiments. The similar portions are designated by like reference numerals and of which explanations are omitted.

An antenna device 300 comprises a base body 110, a conductor antenna 320, a conductor line 341, and the like, which are mounted on a mounting area 340 provided in a main substrate 350. The main substrate 350 is made of the same material as that of the main substrate 150 of the first embodiment. A power feeding port 351 and the conductor line 341 are provided in the main substrate 350. Power is fed to the conductor antenna 320 from the power feeding port 351 through the conductor line 341.

FIG. 15 is a diagram for explaining the assembly processes of the antenna device 300 according to the third embodiment. In the antenna device 300, notch portions 342*aa*, 342*ab*, 342*b* each for fixing the conductor antenna 320 are provided in the mounting area 340. On the other hand, projecting portions 321*aa*, 321*ab* fitting into the notch portions 342*aa*, 342*ab* are provided in a head portion of the end portion 321*a* of the conductor antenna 320. Further, a projecting portion 324*aa* is provided in a portion of the conductor antenna 320 in which both the one end side conductor 321 and the first folded-back portion 324*a* are folded back toward an illustrated lower end.

In the conductor antenna 320 of the antenna device 300, the notch portions 342*aa*, 342*ab*, 342*b* are formed by notches, so that the conductor antenna 320 can be attached to the mounting area 340 only by fitting the projecting portions 321*aa*, 321*ab*, 324*aa* of the conductor antenna 320 into the notches. Therefore, the conductor antenna 320 can be attached to the mounting area 340 by inserting the projecting portions 321*aa*, 321*ab*, 324*aa* into the notches from the illustrated front side or the illustrated upper side. Accordingly, in the antenna device 300, it is possible to select a direction from which the conductor antenna 320 is attached to the mounting area 340. Namely, the conductor antenna 320 can be attached from the direction that is easier for attaching. The conductor antenna 320 is then attached to the mounting area 340 in the same manner as that of the second embodiment.

In addition, in the antenna device 300 according to the third embodiment, a pattern for adjusting transmitting and receiving frequencies 343 is provided on a back surface of the mounting area 340, that is reverse to the surface on which the base body 110, and the like were mounted. The pattern for adjusting transmitting and receiving frequencies 343 is connected to the projecting portions 321*aa*, 321*ab* through the notch portions 342*aa*, 342*ab*. Accordingly, the transmitting and receiving frequencies of the antenna device 300 especially in the GSM band can be adjusted only by chipping a part of the pattern for adjusting transmitting and receiving frequencies 343.

Accordingly, with the constitution thus mentioned, the antenna device 300 according to the third embodiment can obtain advantageous effects similar to those of the antenna device 100 according to the first embodiment.

Next, description is made about a fourth embodiment of the present invention with reference to FIGS. 16 and 17. FIG. 16 is a diagram showing a basic configuration of an antenna device according to a fourth embodiment of the present invention. FIG. 17 is a diagram illustrating assembly processes of the antenna device according to the fourth embodiment. Besides, the fourth embodiment of the present invention has some portions similar to those of the above-described embodiments. The similar portions are designated by like reference numerals and of which explanations are omitted.

An antenna device 400 comprises a base body 110, a conductor antenna 420, a conductor pattern 443, and the like, which are mounted on a sub-substrate 440. Herein, the same one as the sub-substrate 140 of the first embodiment can be used as the sub-substrate 440. However, the conductor line, the cable connector, and the attaching portions in the both end portions are omitted in the sub-substrate 440. Further, a material and a constitution similar to those of the main substrate of the embodiment mentioned above can be used for the main substrate of the fourth embodiment. Then, from the power feeding port at the main substrate side is electrically connected up to the conductor line at the sub-substrate side. Power is fed to the conductor antenna 420 through these conductive members.

In this embodiment, the conductor antenna 420 comprises one end side conductor 421 formed by a metal (a phosphor bronze having a thickness of 0.3 mm) thin plate member, and the other end side conductor 422 constituted by a conductor pattern 443 (shown by alternate long and short dash line) made of a metal foil (copper) and formed on a back surface of the sub-substrate by printing, and the like. A folded-back portion 424 of the one end side conductor 421 and the conductor pattern 443 are connected to each other to produce an approximately U-shaped conductor antenna 420. Then, a flat plane of the one end side conductor 421 and a flat plane of the other end side conductor 422 become substantially perpendicular to each other. Subsequently, the end portion 421*a* of the one end side conductor 421 becomes a power feeding side to be connected to a power feeding port (not shown). On the other hand, the end portion 422*a* of the other end side conductor pattern 443 becomes an open-end terminal side. Further, the one end side conductor 421 is separated from the other end side conductor 422 by way of the sub-substrate. A belt-shaped space 423 is formed between the one end side conductor 421 and the other end side conductor 422. Besides, an alternative embodiment, and the like can be employed. In the alternative embodiment, the belt-shaped space 423 is enlarged, and then a folded-back portion is formed in a head projecting portion 421*aa* of the one end side conductor 421, an another conductor extending within the enlarged belt-shaped space 423 is further constituted.

When the antenna device 400 is assembled, at first, the base body 110 is directly fixed on a predetermined position of the sub-substrate 440 by soldering, and the like. An antenna-fixing hole 442*b* constituted by a through hole is provided in an end portion of the longitudinal direction of the sub-substrate 440. On a back surface following to the through hole fixing hole 442*b*, a conductor pattern 443 made of a copper foil, and the like is formed by printing, or the like. On the other hand, a projecting portions 421*aa* is provided in a head portion of the end portion 421*a* of the conductor antenna 420. Further, a projecting portion 424*aa* is formed in an end portion 424*a* of a folded-back portion of the other end side. Accordingly, the projecting portion 424*aa* of one end side conductor 421 is adjusted and inserted into the antenna-fixing hole 442*b*. The projecting portion 424*aa* is then connected to the conductor pattern 443 and thereafter joined to the conductor pattern 443 by soldering. At that time or after that time, another projecting portion 421*aa* and a part of the end portion 421*a* are connected to the antenna-fixing electrodes 112, 113 and then joined to the antenna-fixing electrodes 112, 113 by soldering. The conductor antenna 420 comprises one end side conductor 421 and the other end side conductor 422 to be approximately U-shaped. Thereby, the conductor antenna 420 is attached and joined to both the base body 110 and the sub-substrate 440. Besides, a fixing hole into which the projecting portion 421*aa* of the one end side conductor 421 is inserted may be provided in the sub-substrate, so that the one end side conductor 421 may also be fitted into and fixed to the sub-substrate.

With the constitution thus mentioned, the antenna device 400 according to the fourth embodiment can obtain advantageous effects similar to those of the antenna device 100 according to the first embodiment.

Next, description is made about a fifth embodiment of the present invention with reference to FIGS. 18 and 19. FIG. 18 is a diagram showing a basic configuration of an antenna device according to a fifth embodiment of the present invention. FIG. 19 is a diagram illustrating assembly processes of the antenna device according to the fifth embodiment. Besides, the fifth embodiment of the present invention has some portions similar to those of the above-described embodiments. The similar portions are designated by like reference numerals and of which explanations are omitted.

An antenna device 500 comprises a base body 110, a conductor antenna 520, a conductor line 530, and the like, which are mounted on a sub-substrate 540. The sub-substrate 540 is provided at a position separated from a main substrate (not shown), similarly to that of the first embodiment. In this sub-substrate 540, attaching portions 140*a*, 140*b* are provided on both ends of longitudinal direction of the sub-substrate 540. A cable connector 531 is mounted on the side of the attaching portion 140*a* in the sub-substrate 540. The cable connector 531 of the sub-substrate 540 is connected to the separated main substrate by the coaxial cable 141.

In this embodiment, an antenna electrode (a second conductor pattern) 511 is formed from an upper surface of the base body 110 to one side surface of the base body 110. A power feeding side electrode (a third conductor pattern) 512 is also formed in the one side surface of the base body 110. Further, the antenna electrode (a second conductor pattern) 511 is joined to an open-end terminal 522*a* of an end of the other end side conductor 522 of a conductor antenna 520, as will later be described, through a joining line (a first conductor pattern) 533. The power feeding side electrode (a third conductor pattern) 512 is joined to a power feeding portion 521*a* of an end of one end side conductor 521 of the conductor antenna 520 through a power feeding line (a fourth conductor pattern) 532. With these constitutions, the base body 110 is adjusted to be existing between the antenna electrode (a second conductor pattern) 511 and the power feeding side electrode (a third conductor pattern) 512, where the antenna electrode (a second conductor pattern) 511 is connected to the open-end terminal 522*a* through the joining line (a first conductor pattern) 533 and where the power feeding side electrode (a third conductor pattern) 512 is connected to the power feeding portion 521*a* through the power feeding line (a fourth conductor pattern) 532. Consequently, the end portion of the one end side conductor 521 is capacitively coupled to the end portion of the other end side conductor 522 through the base body 110.

The conductor antenna 520 is folded at a folded-back portion 524 so that a flat plane of one end side conductor 521 and a flat plane of the other end side conductor 522 may become substantially perpendicular to each other. The conductor antenna 520 is thereby formed to be approximately U-shaped, similarly to that of the first embodiment. Subsequently, an end portion 521*a* of one end side conductor 521 becomes a power feeding side to be connected to the power feeding port by way of the power feeding line (a fourth conductor pattern) 532, the power feeding side electrode (a third conductor pattern) 512, the conductor line 530, and the cable connector 531. On the other hand, an end portion 522*a* of the other end side conductor 522 becomes an open-end terminal side to be connected to the antenna electrode (a second conductor pattern) 511 on the base body 110 by way of the joining line (a first conductor pattern) 533.

When the antenna device 500 is assembled, at first, the base body 110 is directly fixed on a predetermined position of the sub-substrate 540 by soldering, and the like. Further, the conductor antenna 520 is fixed on the sub-substrate 540 by soldering in a manner that the conductor antenna 520 is not in contact with the base body 110. In the sub-substrate 540, notch portions 542*a*, 542*b* and a fixing hole 543 each of which is for use in fixing the conductor antenna 520. The end portion 521*a* of the one end side conductor 521 is formed as a projecting portion 521*aa* fitting into the notch portion 542*a*. A hook portion 624*aa* positioned in a lower end side of the first folded-back portion 524*a* is adjusted to come into contact with the notch portion 542*b*. Further, the end portion 522*a* of the other end side conductor 522 is adjusted to be inserted into the fixing hole 543.

With the constitution mentioned above, the projecting portion 521*aa*, the hook portion 524*aa* are positioned to be corresponding with the notch portions 542*a*, 542*b* and then inserted into the notch portions 542*a*, 542*b*, respectively. In addition, the end portion 522*a* is fitted into the fixing hole 543. The conductor antenna 520 is thereby attached on the sub-substrate 540. At that time or after that time, the projecting portion 521*aa*, the hook portion 524*aa* of the conductor antenna 520 are joined to the notch portions 542*a*, 542*b* by soldering, respectively. In addition, the end portion 522*a* is joined to the fixing hole 543 by soldering. The conductor antenna 520 is thereby fixed on the sub-substrate 540. Besides, the projecting portion 521*aa* is in a manner that the projecting portion 521*aa* comes into contact with the power feeding line 532, when the projecting portion 521*aa* has been joined to the notch portion 542*a*. Similarly, the end portion 522*a* of the other end side conductor 522 is in a manner that the end portion 522*a* comes into contact with the joining line 533, when the end portion 522*a* is joined to the fixing hole 543.

The antenna device 500 according to the fifth embodiment can obtain advantageous effects similar to those of the antenna device 100 according to the first embodiment. Further, since the base body 110 and the conductor antenna 520 are fixed on the sub-substrate 540 independently from each other, the base body 110 and the conductor antenna 520 are in a manner that the base body 110 and the conductor antenna 520 are not dynamically influenced from each other. With the manner, an external force applied on the base body 110 is not transferred to the conductor antenna 520 while, on the contrary, an external force applied on the conductor antenna 520 is not transferred to the base body 110. Further, the base body 110 is directly fixed on the sub-substrate 540. In addition, the conductor antenna 520 is fixed on the sub-substrate 540 by the projecting portion 521*aa*, the hook portion 524*aa*, and the end portion 522*a*. The conductor antenna 520 is therefore supported by three points on the sub-substrate 540. Furthermore, in the antenna device 500, since the base body 110 and the conductor antenna 520 are mounted on the sub-substrate 540 independently from each other. It is therefore possible to freely alternate the order of the base body 110 and the conductor antenna 520 in mounting on the sub-substrate 540 in order to facilitate the mounting thereof. Consequently, assembly of the antenna device becomes easy. Thereby, it becomes possible to improve production efficiency of the antenna device.

Next, description is made about a sixth embodiment of the present invention with reference to FIG. 20. FIG. 20 is a diagram showing a base body that is a characterized portion of an antenna device according to a sixth embodiment of the present invention. Besides, the sixth embodiment of the present invention has constitutions substantially similar to those of the first through the fifth embodiments except that the base body is different from those of the first through the fifth embodiments. Accordingly, the similar portions are designated by like reference numerals and of which explanations are omitted.

In the antenna device 600 according to the sixth embodiment, a pattern for adjusting transmitting and receiving frequencies 643 is provided on the base body 610. Herein, in FIG. 20(*a*), the pattern for adjusting transmitting and receiving frequencies 643 is provided from an upper surface of the base body 610 to one side surface of the base body 610. The pattern for adjusting transmitting and receiving frequencies 643 is extending on the upper surface of the base body 610 from one side thereof at which the other end portion 122*a* of the conductor antenna is joined to the another side thereof. The pattern for adjusting transmitting and receiving frequencies 643 is then folded-back at the another side toward the one side surface of the base body 610. The pattern for adjusting transmitting and receiving frequencies 643 is thereafter extending toward an end portion of the one side surface of the base body 610. Thus, the pattern for adjusting transmitting and receiving frequencies 643 is extended as long as possible on the base body 610.

In FIG. 20(*b*), illustrated is an another example of the base body. Herein, the pattern for adjusting transmitting and receiving frequencies 643' is provided from an upper surface of the base body 610' to one side surface of the base body 610'. The pattern for adjusting transmitting and receiving frequencies 643' is folded at a central portion of the upper surface of the base body 610' toward the one side surface of the base body 610'. Thereafter, the pattern for adjusting transmitting and receiving frequencies 643' is extending toward the other end side of the one side surface of the base body 610'. Consequently, in the base body 610', the pattern for adjusting transmitting and receiving frequencies 643' is extended on two surfaces of the base body 610' in the same direction as each other of the two surfaces. Furthermore, the transmitting and receiving frequencies of the antenna device 600 especially in the GSM band can be adjusted by chipping a part of these patterns for adjusting transmitting and receiving frequencies 643 and 643'.

As explained above, according to the antenna devices of the above embodiments of the present invention, it is made possible to realize an embedded antenna device which can operate in a wide band (quad-band) including GSM band, DCS/PCS bands, and UMTS band, and obtain excellent antenna gain in every band and maintain non-directivity of vertically polarized waves in a space-saving manner. Further, as structural features, the antenna device can be made small in size as a whole, and have a higher degree of freedom of design by adding an insulating base body of a ceramic dielectric body, a ceramic magnetic body, or the like for enabling miniaturization of the antenna device to an approximately U-shaped conductor antenna consisting, for example, of a metal plate having a high degree of freedom of configuration. Further, the antenna device can operate in a plurality of bands by adding one ceramic dielectric body or one ceramic magnetic body to the conductor antenna consisting of one metal plate. It therefore becomes unnecessary that antennas are provided for the bands different from each other per each band. Thereby, saving space can be achieved.

Further, since the base body of a ceramic dielectric body or a ceramic magnetic body is not added between a radiation electrode and a ground conductor but added at a position of the conductor antenna of the metal plate having the folded-back portion (between a head of the metal plate and a near portion of the power feeding portion) where electric field strength between electrodes becomes larger, the antenna device can operate in plenty of frequencies and in a wide band. Further, the metal plate conductor antenna has a constitution that the metal plate conductor antenna is perpendicular to the ground conductor or has many portions perpendicular to the ground conductor. As a result, electrostatic capacity between the metal plate conductor antenna and the ground conductor is reduced. Thereby, the antenna device of the embodiments of the present invention can have an improved radiation efficiency and operate in a wider band. Further, as a functional feature, the antenna device of the embodiments of the present invention can have a band width twice as large as that of an antenna consisting only of a dielectric body. Therefore, antenna gain can be further improved. Furthermore, an advantageous effect of abbreviating wave length can be obtained by adding the base body of a ceramic dielectric body or a ceramic magnetic body. Especially, a dielectric constant can be large by the use of the ceramic dielectric body. Thereby, influence from the other bands can be reduced, so that confusion of directivity or deterioration of VSWR can be prevented from being caused to occur.

Further, since the antenna device of the embodiments of the present invention can have a dielectric constant larger than those of a generally used metal plate antenna and an antenna of such a type that a conductor foil is adhered on a resin, the ceramic dielectric body of the antenna device of the embodiments of the present invention can be small in size. Thereby, effective electrostatic capacity between the metal plate conductor antenna and the ground conductor is reduced. Thereby, the antenna device of the embodiments of the present invention can have an improved radiation efficiency and operate in a wider band. Further, since an effective distance between the metal plate conductor antenna and noise sources can also be reduced, a signal to noise ratio (S/N) is improved. Furthermore, since the metal plate conductor antenna having a certain thickness and a certain width is provided, radiation efficiency of electric waves can be improved. Moreover, a plurality of resonant frequencies can be controlled by adjusting a length of the folded-back conductor antenna and by selecting the dielectric constant of the ceramic dielectric body or a position that the ceramic dielectric body is located. Of course, similar advantageous effects can be obtained in the approximately U-shaped antenna of the present invention, even if the approximately U-shaped antenna is not made of a metal plate. However, when the approximately U-shaped antenna is made of a metal plate, the antenna device can have a comparatively higher degree of freedom of configuration. Accordingly, since the antenna device can be constituted at a low cost, it is favorable that the approximately U-shaped antenna is made of a metal plate.

Further, in the antenna device according to the above embodiments, the base body is directly fixed on a substrate, and then a conductor antenna joined to the base body is also fixed on the substrate. Consequently, the conductor antenna is supported by a plurality of points on the substrate. A load of the conductor antenna acting on the base body can be distributed. Furthermore, when constituted so, such a load as pushing the base body itself onto the substrate can be acted on the base body from the conductor antenna. Consequently, since the conductor antenna is supported by a plurality of points on the substrate, the conductor antenna can be fixed on the substrate with maintaining its stability. It therefore becomes possible to use a conductor antenna having a larger length. On the other hand, the base body directly fixed on the substrate can be released from a stress that is acted by the joined conductor antenna and acting on the base body in the direction of detaching the base body from the substrate. The base body can thereby be fixed on the substrate with maintaining its stability. Accordingly, the antenna device can be prevented from being damaged due to detachment of the base body, and the like. It becomes possible to maintain mechanical reliability of the antenna device.

In the antenna device according to the above embodiments, the conductor antenna is directly supplied with power from the conductor line. However, embodiments of the present invention are not limited to such a manner. For example, let a conductor pattern be provided on the base body, and then the conductor pattern be connected to the conductor line. Thus, power may be fed to the end portion of the conductor antenna through the conductor pattern on the base body. Further, a sub-substrate is fixed in a housing in the first embodiment of the present invention. A sub-substrate may be fixed in a main substrate in the present invention.

POSSIBILITY OF INDUSTRIAL USE

The present invention can be widely applied, as an antenna, not only to a mobile phone but also various wireless communication apparatuses including a GPS (Global Positioning System), wireless LAN, or the like.

DESCRIPTION OF THE REFERENCE NUMERALS

Figure 1:
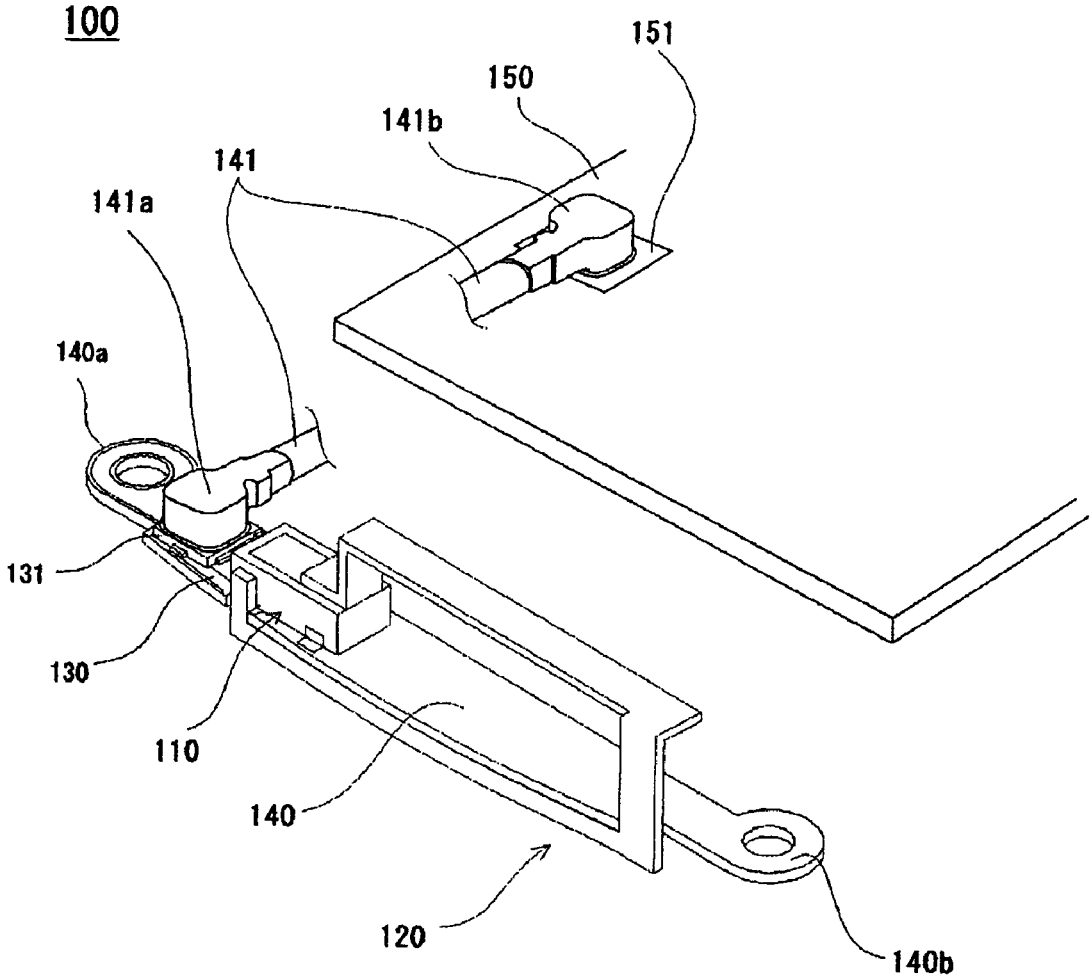
[FIG. 1] is a diagram showing a basic configuration of an antenna device according to a first embodiment of the present invention.
Figure 2:
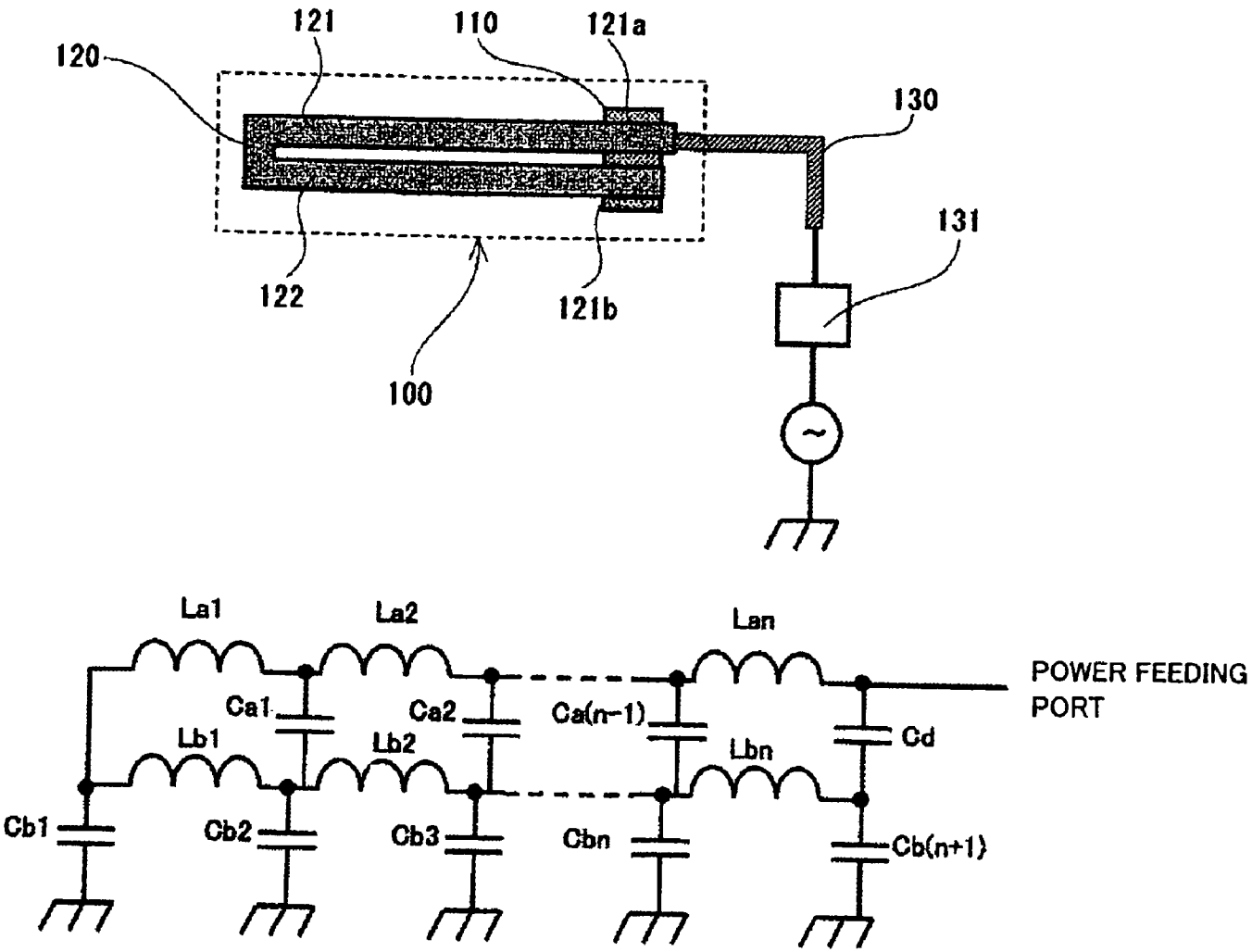
[FIG. 2] is a diagram illustrating an equivalent circuit of the antenna device shown in FIG. 1.
Figure 3:
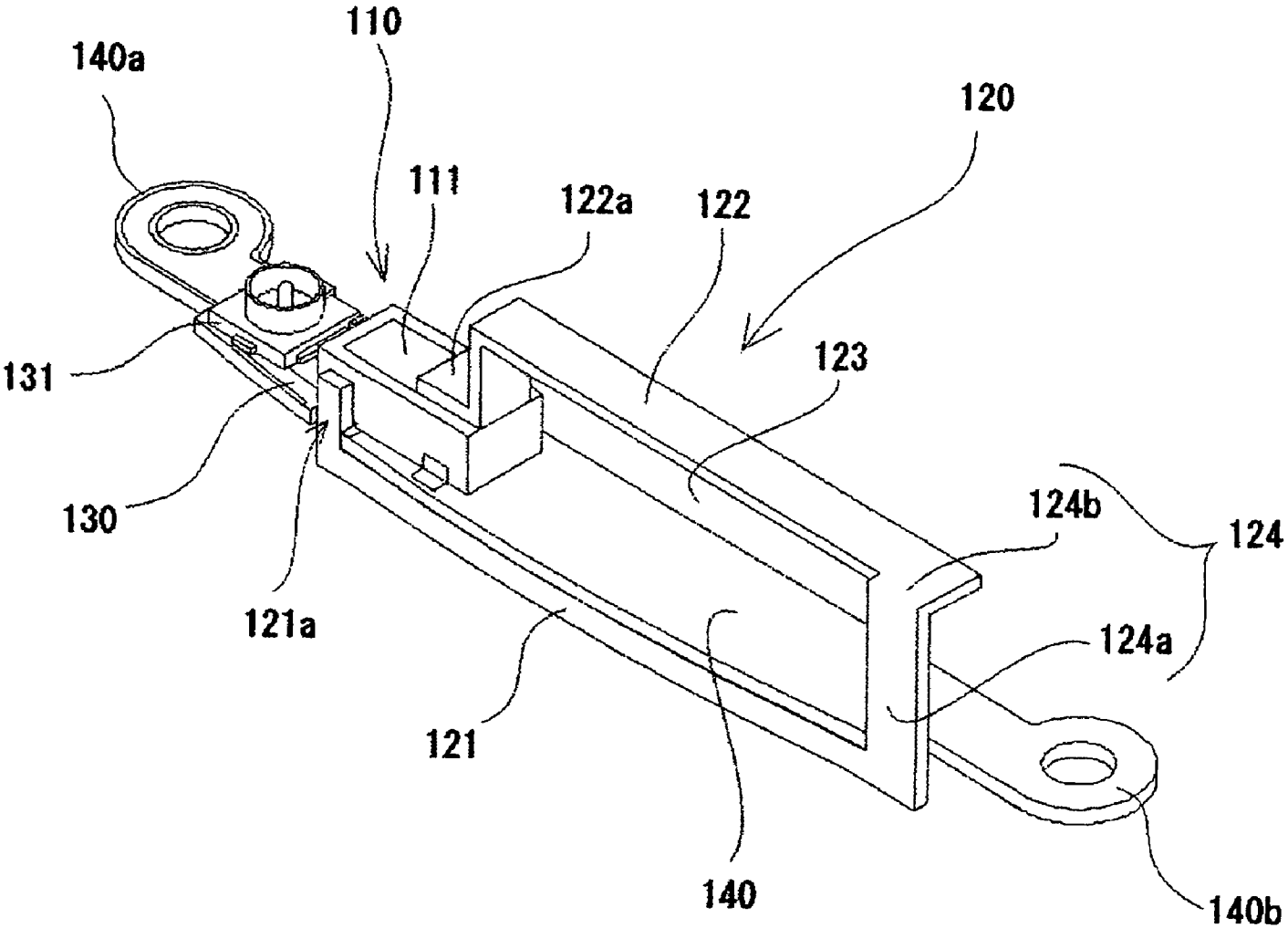
[FIG. 3] is a diagram illustrating a detail of the antenna device shown in FIG. 1.
Figure 4:
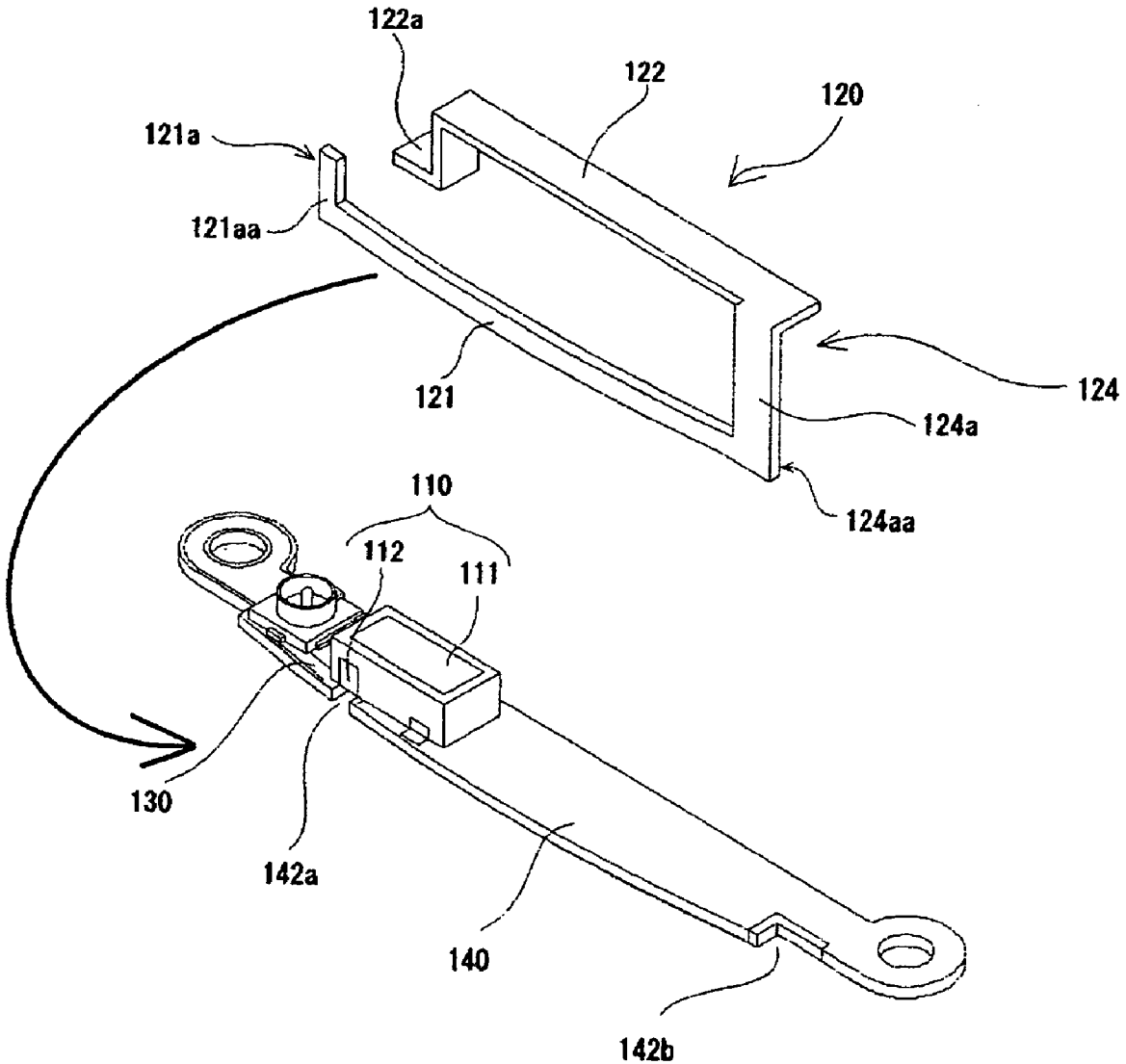
[FIG. 4] is a diagram illustrating assembly processes of the antenna device shown in FIG. 1.
Figure 5:
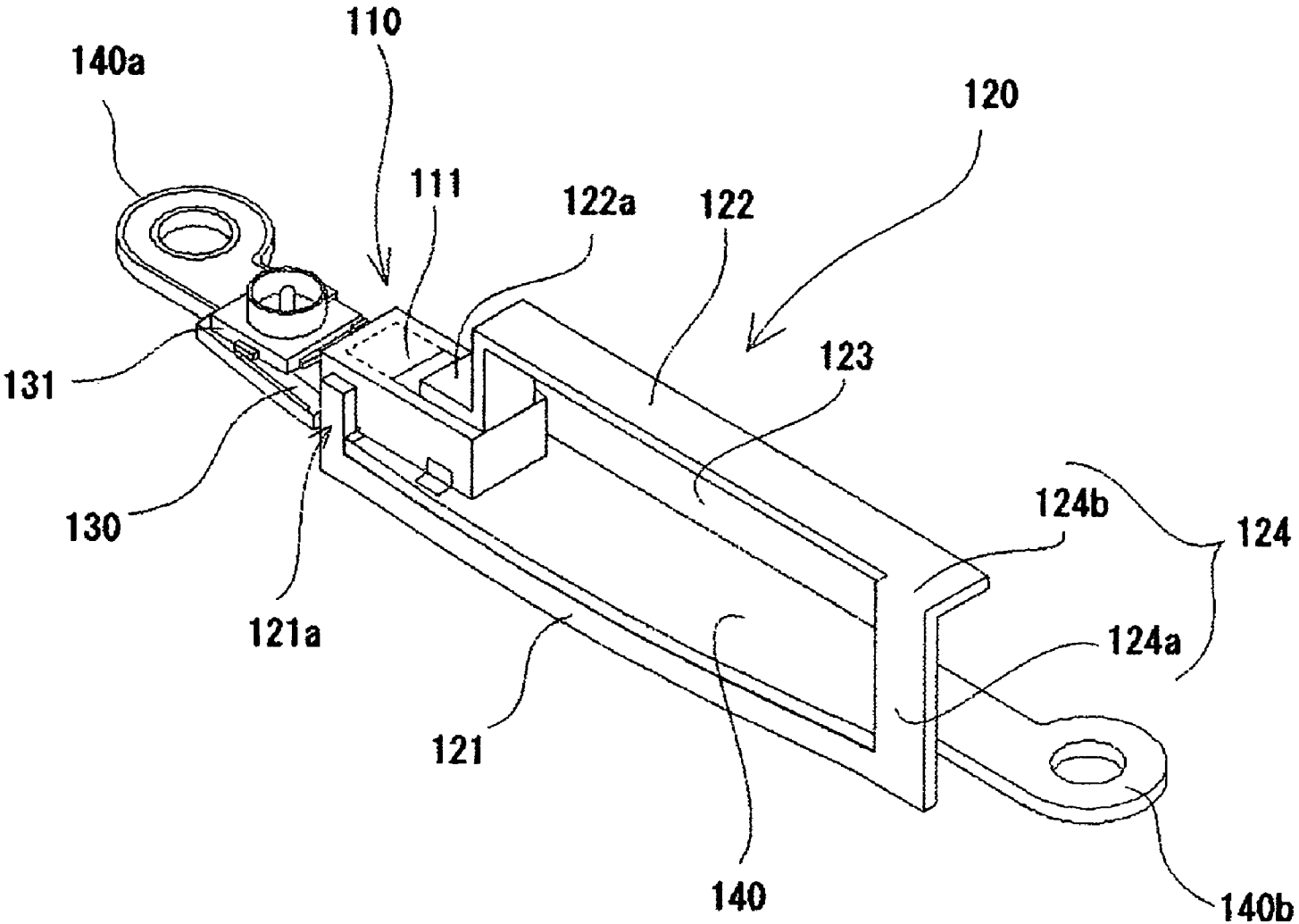
[FIG. 5] is a diagram for explaining a method of adjusting transmitting and receiving frequencies of the antenna device shown in FIG. 1.
Figure 6:
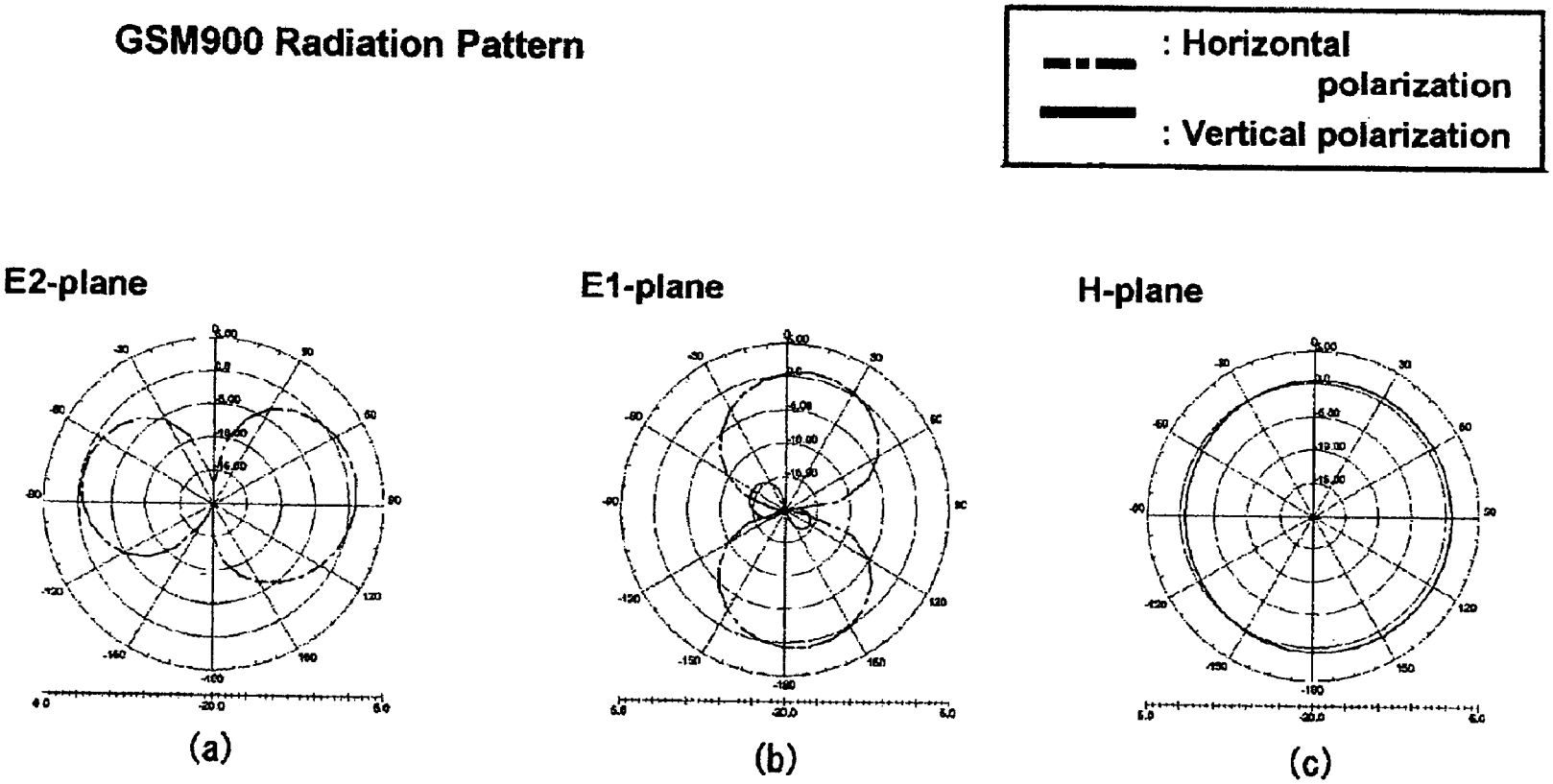
[FIG. 6] is a diagram illustrating an antenna characteristic of the antenna device shown in FIG. 1 in a GSM band.
Figure 7:
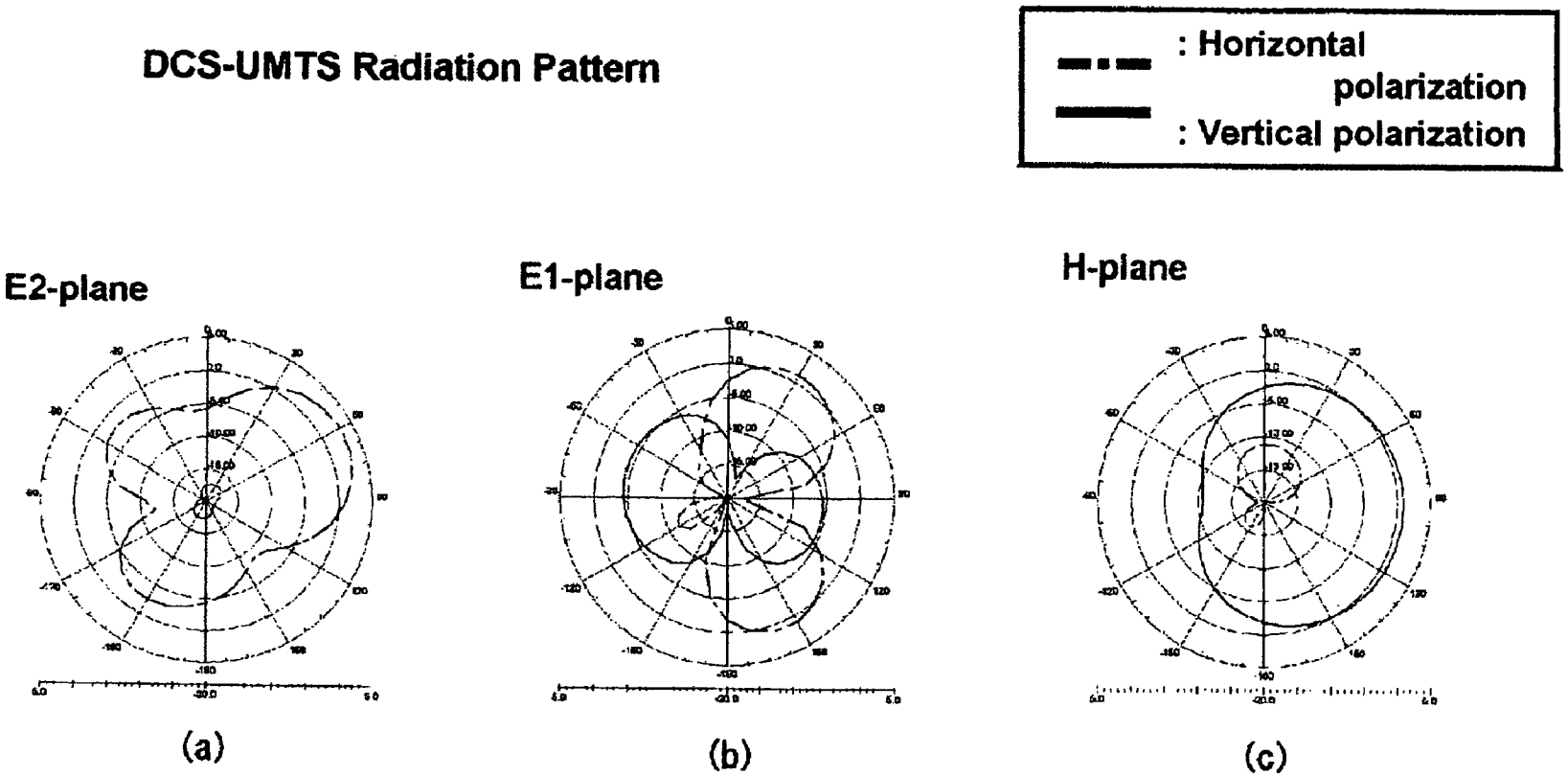
[FIG. 7] is a diagram illustrating an antenna characteristic of the antenna device shown in FIG. 1 in DCS-UMTS bands.
Figure 8:
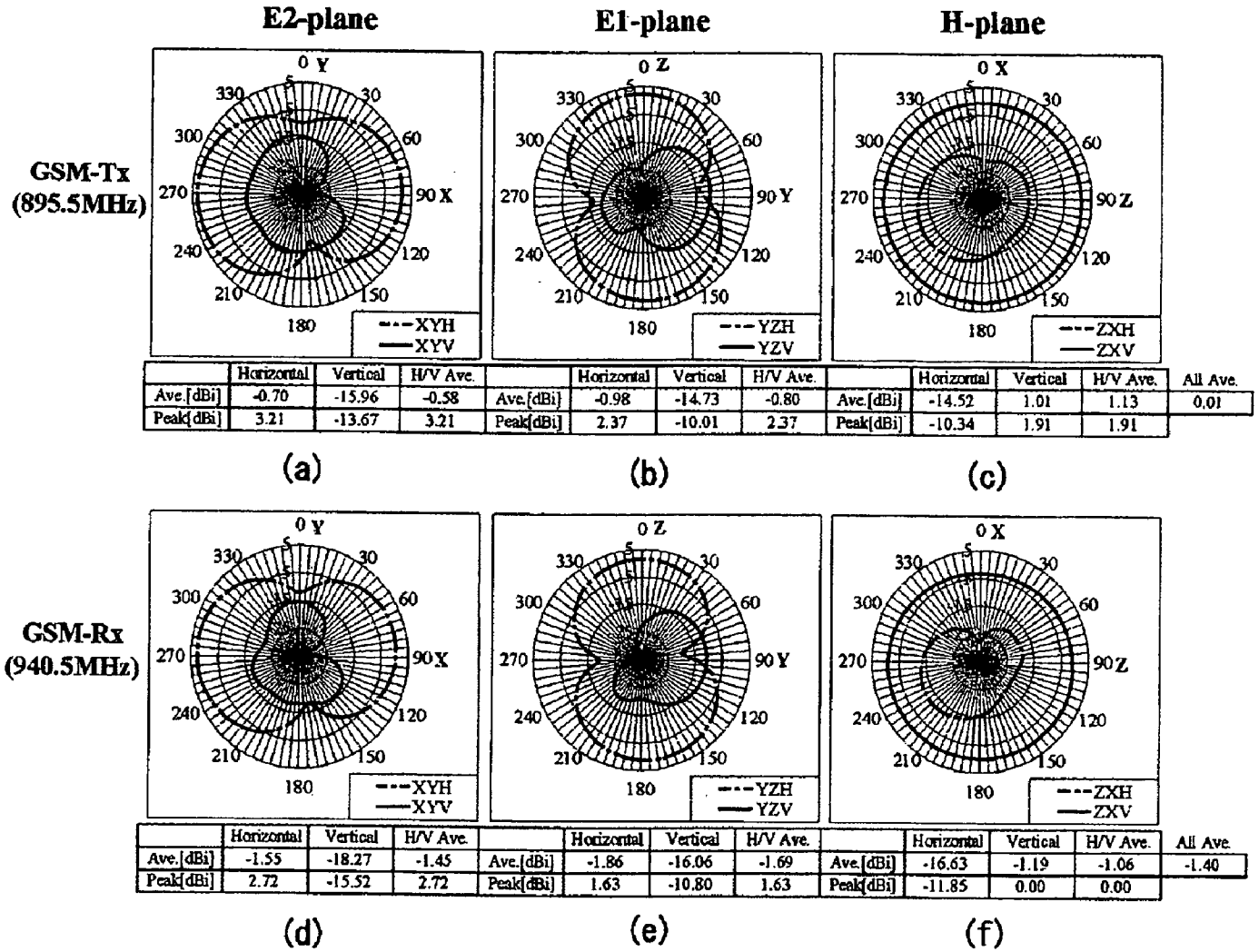
[FIG. 8] is a diagram illustrating an antenna gain directivity characteristic of the antenna device shown in FIG. 1 in a GSM band.
Figure 9:
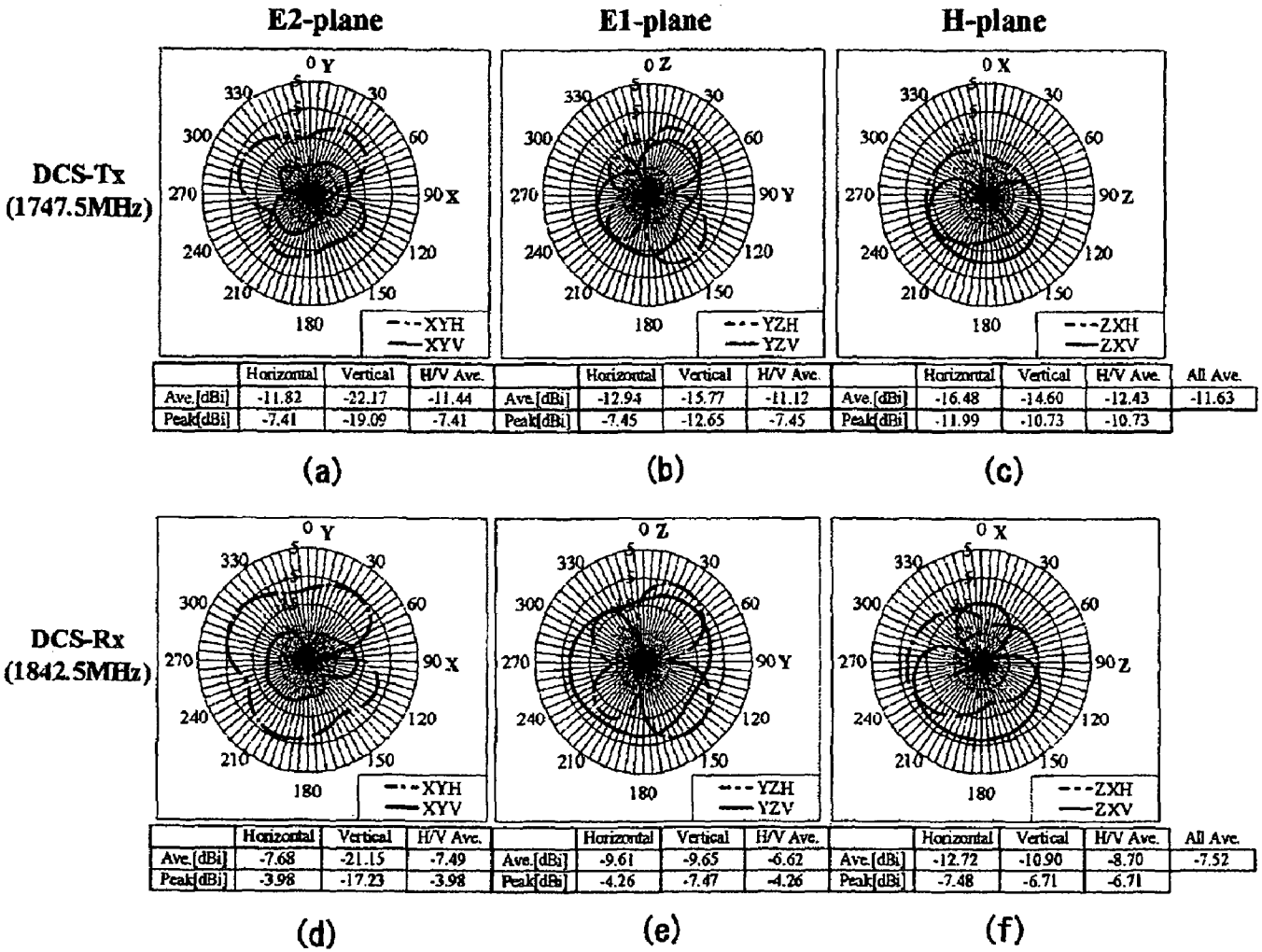
[FIG. 9] is an another diagram illustrating an antenna gain directivity characteristic of the antenna device shown in FIG. 1 in a DCS band.
Figure 10:
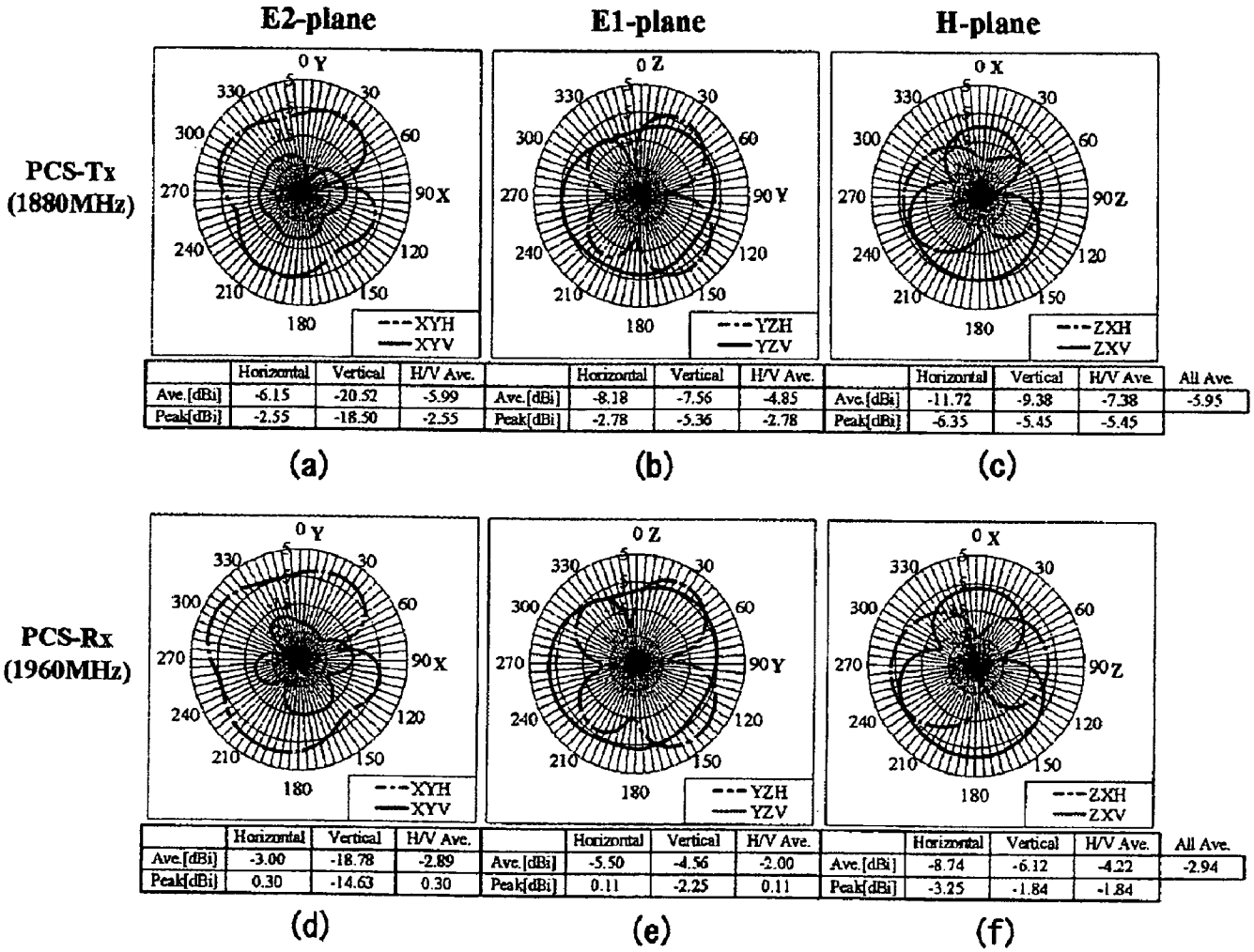
[FIG. 10] is a yet another diagram illustrating an antenna gain directivity characteristic of the antenna device shown in FIG. 1 in a PCS band.
Figure 11:
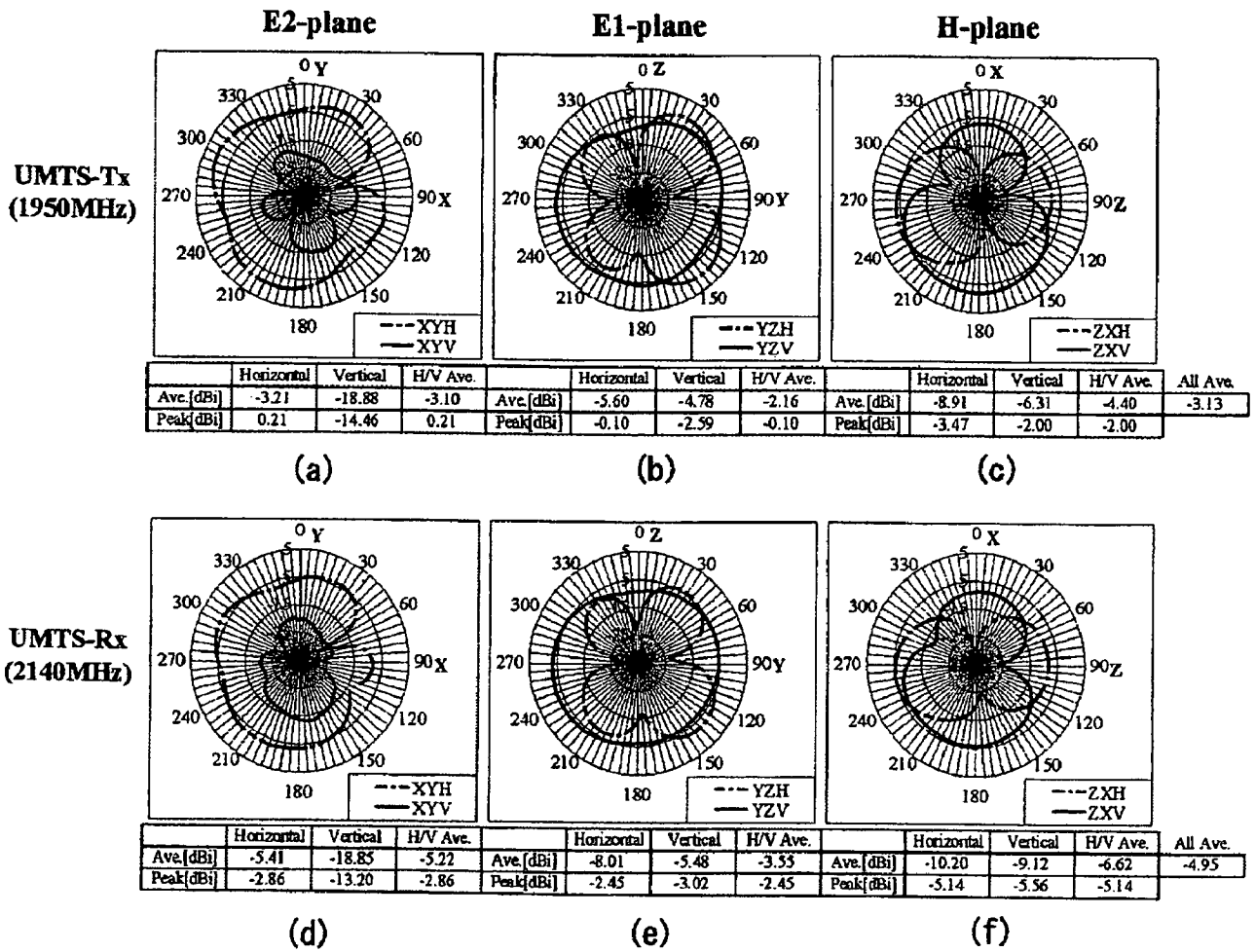
[FIG. 11] is a still another diagram illustrating an antenna characteristic of the antenna device shown in FIG. 1 in a UMTS band.
Figure 12:
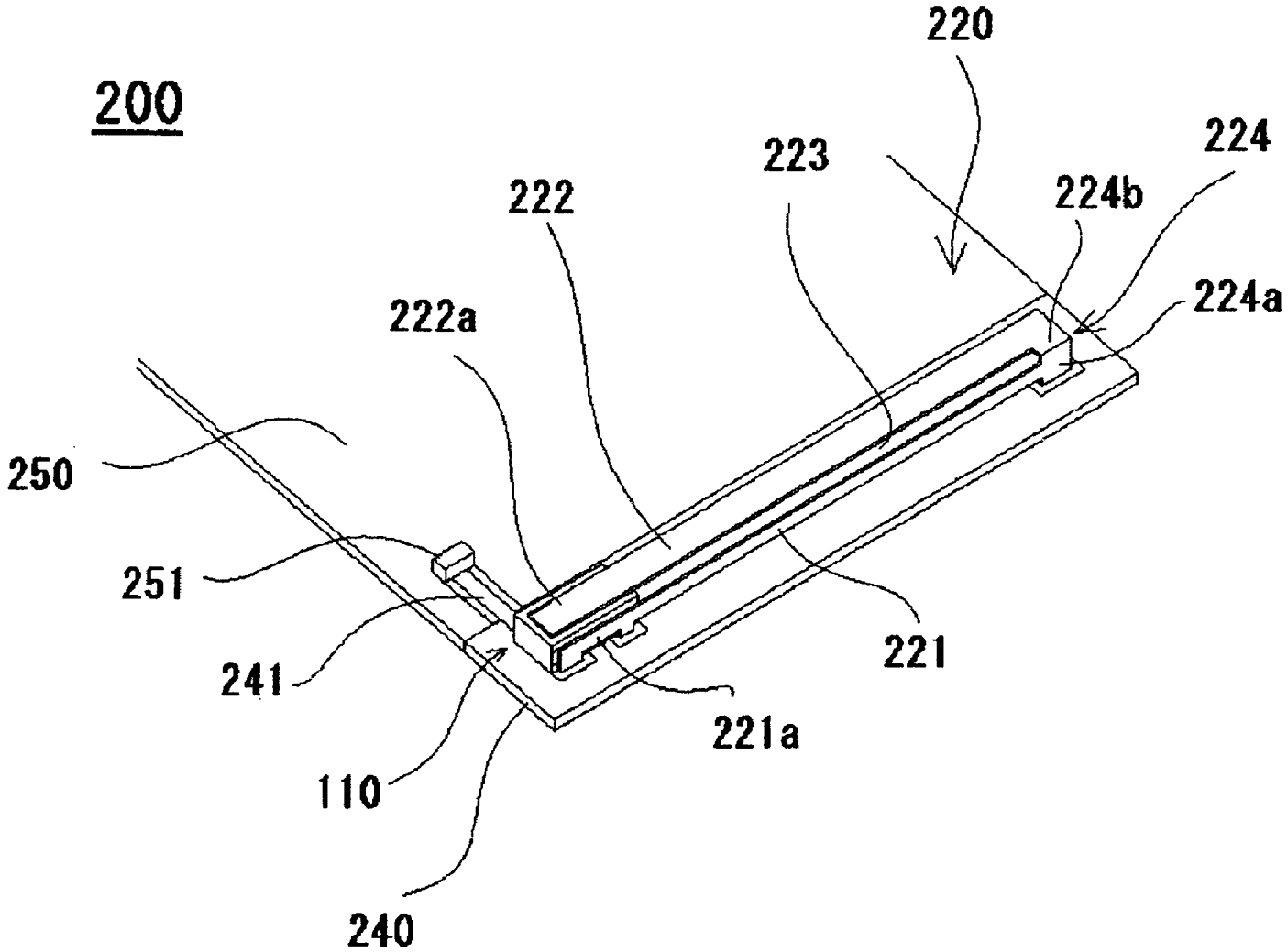
[FIG. 12] is a diagram showing a basic configuration of an antenna device according to a second embodiment of the present invention.
Figure 13:
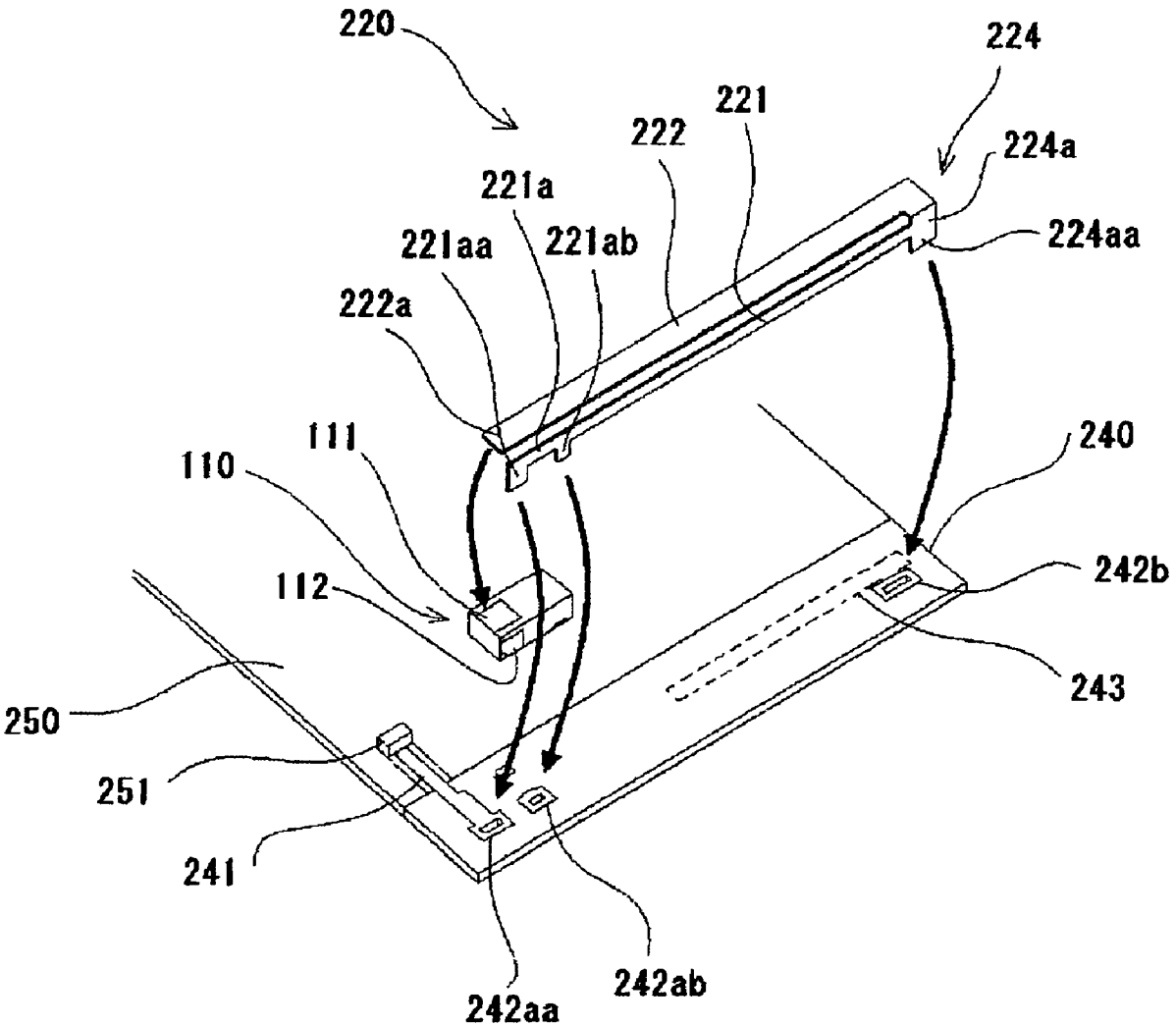
[FIG. 13] is a diagram illustrating assembly processes of the antenna device shown in FIG. 12.
Figure 14:
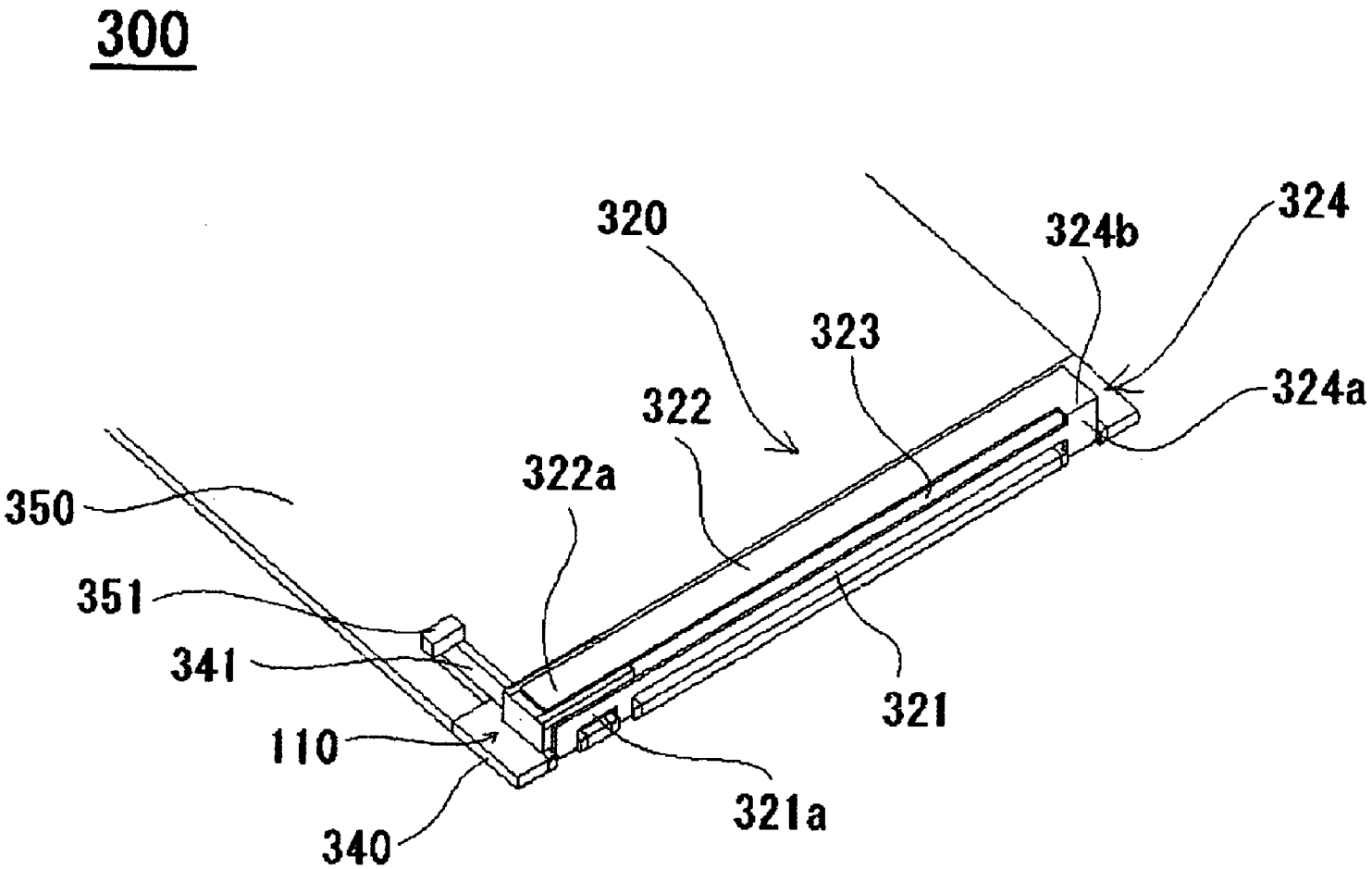
[FIG. 14] is a diagram showing a basic configuration of an antenna device according to a third embodiment of the present invention.
Figure 15:
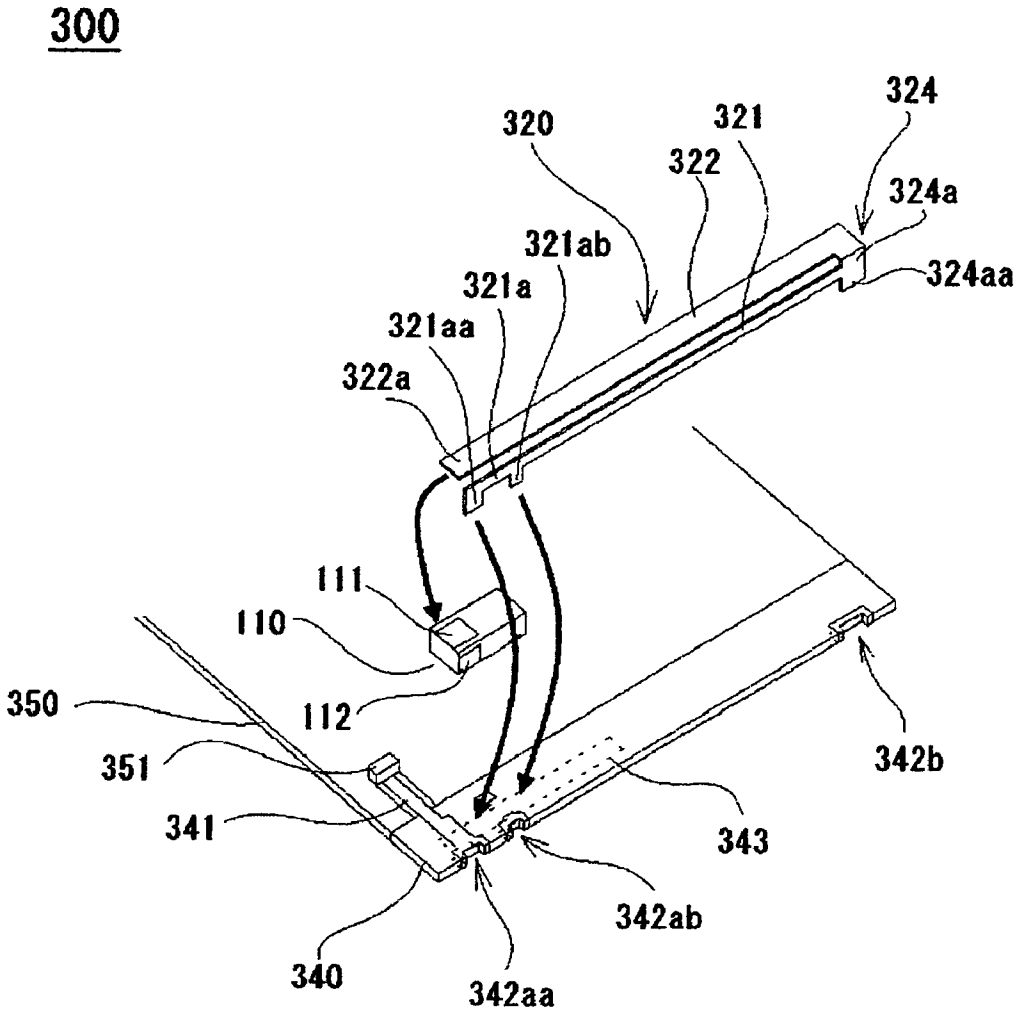
[FIG. 15] is a diagram illustrating assembly processes of the antenna device shown in FIG. 14.
Figure 16:
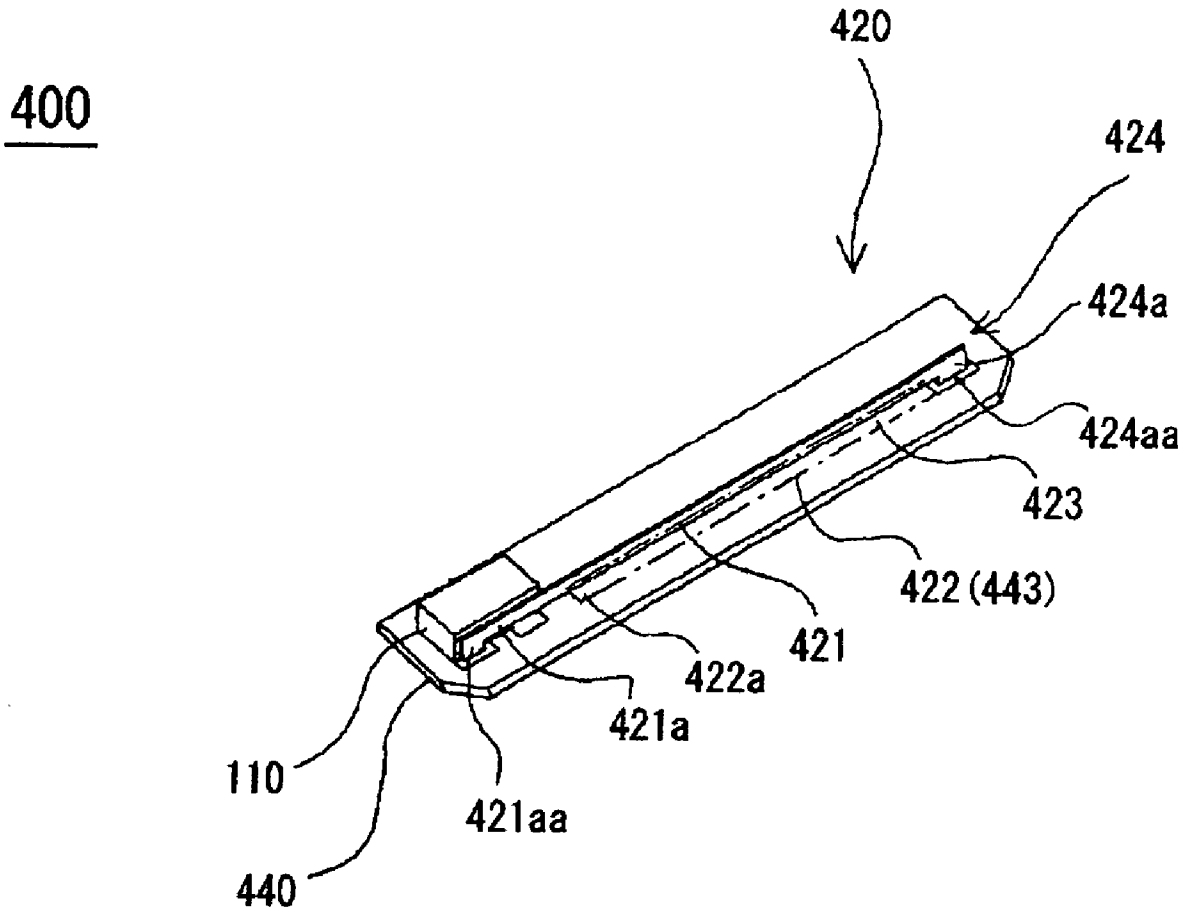
[FIG. 16] is a diagram showing a basic configuration of an antenna device according to a fourth embodiment of the present invention.
Figure 17:
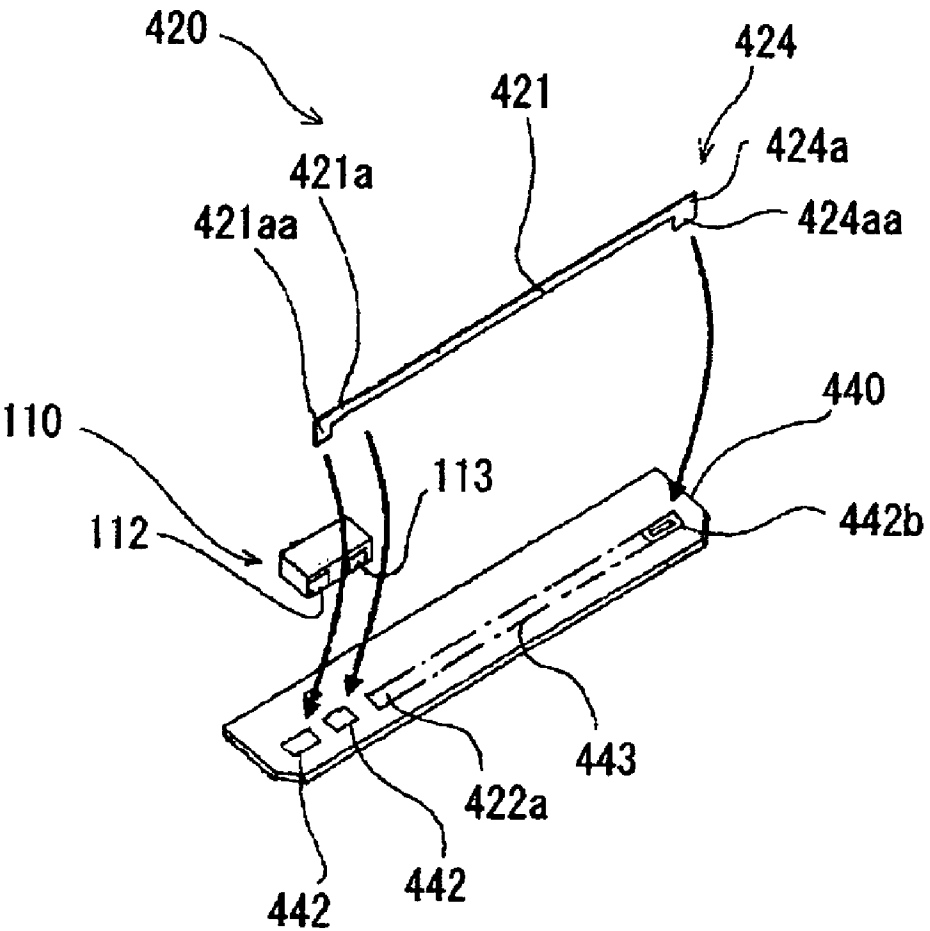
[FIG. 17] is a diagram illustrating assembly processes of the antenna device shown in FIG. 16.
Figure 18:
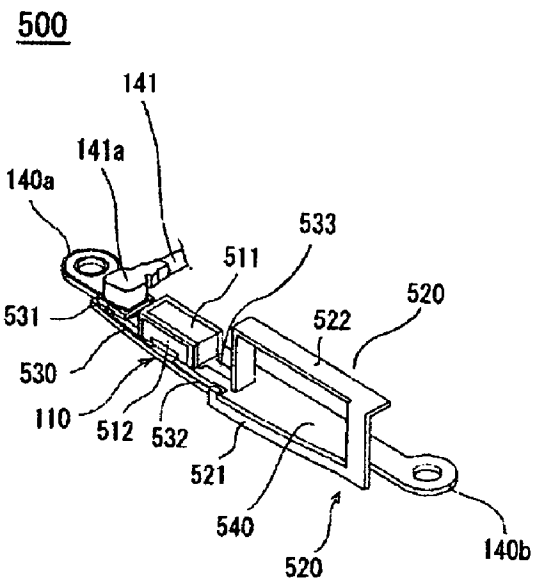
[FIG. 18] is a diagram showing a basic configuration of an antenna device according to a fifth embodiment of the present invention.
Figure 19:
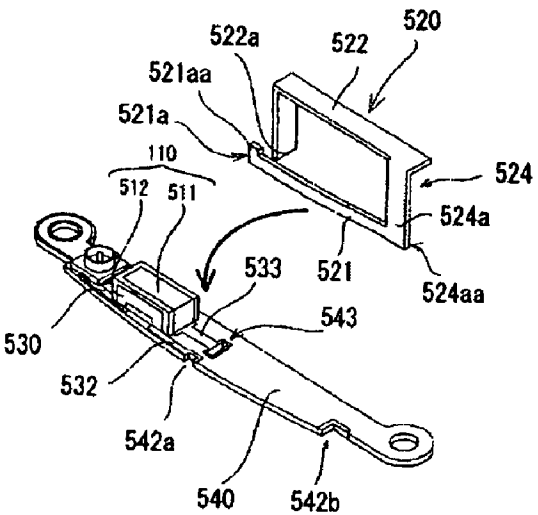
[FIG. 19] is a diagram illustrating assembly processes of the antenna device shown in FIG. 18.
Figure 20:
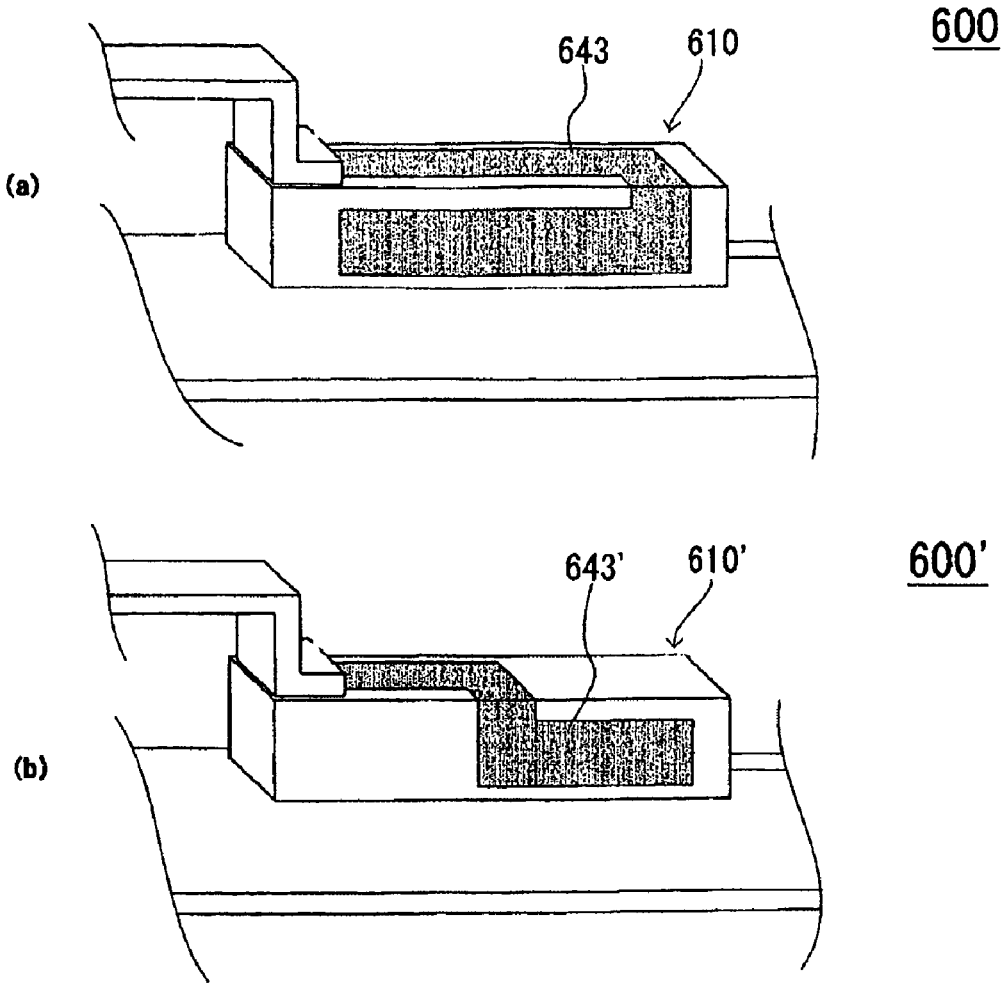
[FIG. 20] is a diagram showing a sixth embodiment of the present invention.

100, 200, 300, 400, 500, 600: antenna device, 110, 410, 610: base body, 111, 112: electrode for fixing antenna, 120, 210, 320, 420, 520: conductor antenna, 121, 221, 321, 421, 521: conductor of one end side, 122, 222, 322, 422, 522: conductor of the other end side, 121*a*, 122*a*, 221*a*, 222*a*, 321*a*, 322*a*, 421*a*, 422*a*, 521*a*, 522*a*: end portion, 121*aa*, 221*aa*, 221*ab*, 224*aa*, 321*aa*, 321*ab*, 324*aa*, 424*aa*, 521*aa*: projecting portion, 124*aa*, 324*aa*, 524*aa*: hook portion, 123, 223, 323, 423: space, 124, 224, 324, 524: folded-back portion, 124*a*, 224*a*, 324*a*, 524*a*: first folded-back portion, 124*b*, 224*b*, 324*b*: second folded-back portion, 130, 241, 341, 530: conductor line, 131: cable connector, 140, 440, 540: sub-substrate, 140*a*, 140*b*: attaching portion, 141: coaxial cable, 141*a*, 141*b*: connecting portion, 142*a*, 142*b*, 242*aa*, 242*ab*, 242*b*, 342*aa*, 342*ab*, 342*b*, 542*a*, 542*b*: notch portion, 150, 250, 350: main substrate, 151, 251, 351: electric power feeding port, 221*aa*, 221*ab*, 224*aa*, 321*aa*, 321*ab*, 324*aa*: hook-projecting portion, 240, 340: mounting area, 243, 343, 643: pattern for adjusting transmitting and receiving frequencies, 443: conductor pattern, 543: fixing hole, 533: line for joining first conductor pattern), 511: antenna electrode (second conductor pattern), 512: power feeding side electrode (third conductor pattern), 532: line for power feeding (fourth conductor pattern)

The invention claimed is:

1. An antenna device comprising:

an approximately U-shaped conductor antenna, on one end side of which a power feeding portion is provided and on the other end side of which an end portion is provided as an open end terminal, and which has a folded-back portion;

a base body made of an insulating material;

a substrate on which said conductor antenna and said base body are mounted;

conductor planes of said one end side and said the other end side of said conductor antenna constituted to be approximately perpendicular to each other;

said base body being fixed on said substrate;

at least said one end side of said conductor antenna being fixed on said base body; and said folded-back portion being fixed on said substrate.

2. The antenna device as claimed in claim 1, wherein said one end side of said conductor antenna is also fixed on said substrate.

3. The antenna device as claimed in claim 1, wherein a hook portion for fixing said conductor antenna on said substrate is provided in said conductor antenna while a notch portion corresponding to said hook portion is formed in said substrate.

4. The antenna device as claimed in claim 1, wherein a projecting portion for fixing said conductor antenna on said substrate is provided in said conductor antenna while a hole portion corresponding to said projecting portion is formed in said substrate.

5. The antenna device as claimed in claim 1, wherein the one end side of said conductor antenna comprises a plate-shaped conductor and the other end side of said conductor antenna comprises a conductor pattern formed on a back surface of said substrate, an end portion of said plate-shaped conductor near said folded-back portion at the one end side being hooked into a hole portion or a notch portion formed on said substrate and being joined to said conductor pattern at the other end side, and said conductor antenna being fixed on said substrate.

6. The antenna device as claimed in claim 1, wherein the one end side and the other end side of said conductor antenna are located closely to each other through said base body, said open end terminal of the other end portion of said conductor antenna and said base body are joined to each other, and thereby said conductor antenna is supportively fixed by said substrate and said base body.

7. The antenna device as claimed in claim 1, wherein said base body is fixed on said substrate, said open end terminal of the other end side of said conductor antenna and said base body are independently fixed on said substrate, respectively, in a condition that said open end terminal of the other end side and said base body are separated from each other.

8. The antenna device as claimed in claim 7, wherein a first conductor pattern is provided on said substrate while a second conductor pattern is formed on said base body, said second conductor pattern and said open end terminal of the other end side of said conductor antenna being connected to each other through said first conductor pattern, a third conductor pattern being formed on said base body while a fourth conductor pattern being provided on said substrate, power being fed into said power feeding portion of said conductor antenna through said third conductor pattern and said fourth conductor pattern.

9. The antenna device as claimed in claim 1, wherein a conductor pattern for adjusting transmitting and receiving frequencies is formed on at least one of said base body and said substrate.

10. The antenna device as claimed in claim 1, wherein said substrate comprises a sub-substrate connected to a main substrate.

11. A wireless communication apparatus comprising said antenna device as claimed in claim 1, said antenna device being embedded in said wireless communication apparatus.

12. The antenna device as claimed in claim 2, wherein a hook portion for fixing said conductor antenna on said substrate is provided in said conductor antenna while a notch portion corresponding to said hook portion is formed in said substrate.

13. The antenna device as claimed in claim 2, wherein a projecting portion for fixing said conductor antenna on said substrate is provided in said conductor antenna while a hole portion corresponding to said projecting portion is formed in said substrate.

14. The antenna device as claimed in claim 3, wherein a projecting portion for fixing said conductor antenna on said substrate is provided in said conductor antenna while a hole portion corresponding to said projecting portion is formed in said substrate.

15. The antenna device as claimed in claim 2, wherein the one end side of said conductor antenna comprises a plate-shaped conductor and the other end side of said conductor antenna comprises a conductor pattern formed on a back surface of said substrate, an end portion of said plate-shaped conductor near said folded-back portion at the one end side being hooked into a hole portion or a notch portion formed on said substrate and being joined to said conductor pattern at the other end side, and said conductor antenna being fixed on said substrate.

16. The antenna device as claimed in claim 3, wherein the one end side of said conductor antenna comprises a plate-shaped conductor and the other end side of said conductor antenna comprises a conductor pattern formed on a back surface of said substrate, an end portion of said plate-shaped conductor near said folded-back portion at the one end side being hooked into a hole portion or a notch portion formed on said substrate and being joined to said conductor pattern at the other end side, and said conductor antenna being fixed on said substrate.

17. The antenna device as claimed in claim 4, wherein the one end side of said conductor antenna comprises a plate-shaped conductor and the other end side of said conductor antenna comprises a conductor pattern formed on a back surface of said substrate, an end portion of said plate-shaped conductor near said folded-back portion at the one end side being hooked into a hole portion or a notch portion formed on said substrate and being joined to said conductor pattern at the other end side, and said conductor antenna being fixed on said substrate.

18. The antenna device as claimed in claim 2, wherein said base body is fixed on said substrate, said open end terminal of the other end side of said conductor antenna and said base body are independently fixed on said substrate, respectively, in a condition that said open end terminal of the other end side and said base body are separated from each other.

19. The antenna device as claimed in claim 3, wherein said base body is fixed on said substrate, said open end terminal of the other end side of said conductor antenna and said base body are independently fixed on said substrate, respectively, in a condition that said open end terminal of the other end side and said base body are separated from each other.

20. The antenna device as claimed in claim 4, wherein said base body is fixed on said substrate, said open end terminal of the other end side of said conductor antenna and said base body are independently fixed on said substrate, respectively, in a condition that said open end terminal of the other end side and said base body are separated from each other.

* * * * *